US010864138B2

(12) United States Patent
Stafeil

(10) Patent No.: US 10,864,138 B2
(45) Date of Patent: Dec. 15, 2020

(54) TAMPER-EVIDENT LABEL

(71) Applicant: Brady Worldwide, Inc., Milwaukee, WI (US)

(72) Inventor: Kevin Stafeil, Delafield, WI (US)

(73) Assignee: BRADY WORLDWIDE, INC., Milwaukee, WI (US)

( * ) Notice: Subject to any disclaimer, the term of this patent is extended or adjusted under 35 U.S.C. 154(b) by 419 days.

(21) Appl. No.: 15/928,760

(22) Filed: Mar. 22, 2018

(65) Prior Publication Data

US 2018/0303712 A1 Oct. 25, 2018

Related U.S. Application Data

(60) Provisional application No. 62/479,461, filed on Mar. 31, 2017, provisional application No. 62/537,763, filed on Jul. 27, 2017.

(51) Int. Cl.

| | |
|---|---|
| ***A61J 1/18*** | (2006.01) |
| ***B65C 3/02*** | (2006.01) |
| ***A61J 1/10*** | (2006.01) |
| ***G09F 3/02*** | (2006.01) |
| ***G09F 3/10*** | (2006.01) |
| ***G09F 3/00*** | (2006.01) |

(52) U.S. Cl.

CPC . *A61J 1/18* (2013.01); *A61J 1/10* (2013.01); *B65C 3/02* (2013.01); *G09F 3/02* (2013.01); *G09F 3/0292* (2013.01); *G09F 3/0295* (2013.01); *G09F 3/10* (2013.01); *A61J 2205/30* (2013.01); *G09F 2003/0269* (2013.01)

(58) Field of Classification Search

CPC .... A61J 1/18; A61J 1/10; A61J 1/1475; A61J 2205/30; B65D 3/02; B65D 23/14; B65D 2401/00; B65D 2401/05; B65D 83/7575; G09F 3/02; G09F 3/0292; G09F 3/0295; G09F 3/10; G09F 3/04; G09F 2003/0269; G09F 3/0341; B32B 2519/00

USPC ..... 229/123.1, 123.2, 87.05; 156/250, 277, 156/69, 211, 252; 428/43, 41.8, 42.2, 428/42.3, 915, 916; 283/81; 206/807; 604/111

See application file for complete search history.

(56) References Cited

U.S. PATENT DOCUMENTS

| | | | |
|---|---|---|---|
| 4,266,687 | A | 5/1981 | Cummings |
| 4,390,104 | A | 6/1983 | Cummings |
| 4,423,819 | A | 1/1984 | Cummings |
| 4,514,248 | A | 4/1985 | Cummings |

(Continued)

*Primary Examiner* — Christopher R Demeree

(74) *Attorney, Agent, or Firm* — Husch Blackwell LLP

(57) ABSTRACT

A label includes (a) a base segment, (b) a first lobe segment comprising at least one protruding member and a pull tab, (c) a second lobe segment comprising at least one protruding member, (d) a first cutout segment, (e) a second cutout segment, (f) a first perforation forming a boundary between the base and first lobe segments, (g) a second perforation forming a boundary between the base and second lobe segments, and (h) a third perforation forming a boundary between the first lobe segment and its at least one protruding member. The first and second lobe segments are connected to the base segment and opposed to one another. The first and second cutout segments separate the at least one protruding member of the first and second lobe segments, respectively, from the base segment. The label comprises at least (A) a facesheet layer and (B) an adhesive layer.

20 Claims, 6 Drawing Sheets

(56) References Cited

U.S. PATENT DOCUMENTS

| | | | | |
|---|---|---|---|---|
| 4,527,703 | A | 7/1985 | Cummings | |
| 4,598,834 | A | 7/1986 | Singletary | |
| 4,666,052 | A | 5/1987 | Ou-Yang | |
| 5,197,618 | A | 3/1993 | Goth | |
| 5,506,015 | A | 4/1996 | Frederiksen et al. | |
| 5,514,442 | A | 5/1996 | Galda et al. | |
| 5,718,859 | A | 2/1998 | Frederiksen et al. | |
| D465,572 | S * | 11/2002 | Dunshee | D24/145 |
| 6,578,723 | B1 | 6/2003 | Tyner | |
| 6,685,228 | B2 * | 2/2004 | Riley | G09F 3/0288 283/101 |
| 6,698,928 | B2 * | 3/2004 | Miller | B65D 83/7575 383/205 |
| 8,002,113 | B1 | 8/2011 | Cummings | |
| 8,230,996 | B1 | 7/2012 | Cummings et al. | |
| 8,920,590 | B1 | 12/2014 | Cummings et al. | |
| 9,592,656 | B1 | 3/2017 | Davies et al. | |
| 9,624,008 | B2 | 4/2017 | Thorstensen-Woll et al. | |
| 10,377,545 | B2 * | 8/2019 | Porter | B65H 18/28 |
| 2004/0060892 | A1 | 4/2004 | Heston et al. | |

* cited by examiner

TAMPER-EVIDENT LABEL

FIELD OF THE INVENTION

This invention relates to labels. In one aspect the invention relates to tamper-evident labels while in another aspect the invention relates to tamper-evident labels for medical consumables, such as IV ports, syringes and other medical equipment.

BACKGROUND OF THE INVENTION

IV port labels have two primary functions. First, the labels cover the injection point of IV ports, thereby limiting contamination. Second, the presence of an IV port label alerts pharmacy staff that a medication has already been added to an IV bag, thereby limiting potential double-dosing. Many IV port labels also serve a third function, namely, warning of potential tampering. Currently, many IV port labels incorporate perforations as an additional mechanism to address potential tampering. The perforations provide an initiation point to propagate a tear. A tear in the IV port label presents a visual indicator to healthcare professionals that the IV bag, port or contents of the IV bag may have been tampered with.

Unfortunately, many current IV port labels show significant failure rates. Current IV port labels can fail through two primary mechanisms. First, the entire label can slip off the IV port, much like removing a cap from a pen. This form of failure is seen when the chemical used to clean IV ports before and after a medication is introduced to the IV bag (e.g., isopropyl alcohol, or "IPA") creates a barrier on the IV port and decreases adhesion between the label and the IV port. With such a failure, there is no indication that a medicine has been injected into the bag, increasing the risk of double dosing, and the IV port is exposed, increasing the risk of contamination.

Second, perforations and/or label design may expose the adhesive and/or injection port. For example, depending on IV port label design, improper securing of the label at the IV port may expose a portion of the adhesive. Potential contaminants can collect on the exposed adhesive, thereby increasing the risk of contamination. Similarly, a tear may be prematurely propagated through perforations in the IV port label. Premature tearing of the perforations not only exposes the IV port to potential contamination, but also raises the question of potential tampering.

The failure of labels on other medical supplies (e.g., medical consumables like syringes, containers, etc.) creates similar concerns with respect to medication or dosing errors, questions of tampering, and contamination.

Considering the above, it is easy to see that IV port label failures, and label failures on other medical supplies, create problems for healthcare professionals and add cost to the healthcare provider. These problems and costs can range from being quite minimal (e.g., the need to use a second label) to being very significant (e.g., the need to dispose of a drug).

Ideally, a tamper-evident label, and more specifically, for example, an IV port label, will show decreased instances of failure while still providing a tamper-indicator.

SUMMARY OF THE INVENTION

In one embodiment the invention is label. In accordance with embodiments of the present disclosure, a label comprises (a) a base segment, (b) a first lobe segment comprising at least one protruding member and a pull tab, (c) a second lobe segment comprising at least one protruding member, (d) a first cutout segment, (e) a second cutout segment, (f) a first perforation forming a boundary between the base segment and the first lobe segment, (g) a second perforation forming a boundary between the base segment and the second lobe segment, and (h) a third perforation forming a boundary between the first lobe segment and the at least one protruding member of the first lobe segment; wherein the first lobe segment is connected to the base segment and the second lobe segment is connected to the base segment and opposed to the first lobe segment, wherein the first cutout segment separates the at least one protruding member of the first lobe segment from the base segment, wherein the second cutout segment separates the at least one protruding member of the second lobe segment from the base segment, and wherein the label comprises at least (A) a facesheet layer and (B) an adhesive layer.

In an embodiment the invention is a release liner. In accordance with embodiments of the present disclosure, a release liner comprises (a) a base segment, (b) a first lobe segment comprising at least one protruding member and a pull tab, (c) a second lobe segment comprising at least one protruding member, (d) a first cutout segment, (e) a second cutout segment, (f) a first perforation forming a boundary between the base segment and the first lobe segment, (g) a second perforation forming a boundary between the base segment and the second lobe segment, and k a third perforation forming a boundary between the first lobe segment and the at least one protruding member of the first lobe segment; wherein the first lobe segment is connected to the base segment and the second lobe segment is connected to the base segment and opposed to the first lobe segment, wherein the first cutout segment separates the at least one protruding member of the first lobe segment from the base segment, wherein the second cutout segment separates the at least one protruding member of the second lobe segment from the base segment, wherein the label comprises at least (A) a facesheet layer and (B) an adhesive layer, wherein the adhesive layer comprises a first facial surface and a second facial surface, and the second facial surface is in contact with the release liner.

In an embodiment the invention is an IV bag. According to embodiments of the present disclosure, an IV comprises an IV port, the IV port (1) having (i) a terminal portion comprising a terminal surface and (ii) a tubing portion and (2) bearing a label, the label comprising (a) a base segment, (b) a first lobe segment comprising at least one protruding member and a pull tab, (c) a second lobe segment comprising at least one protruding member, (d) a first cutout segment, (e) a second cutout segment, (f) a first perforation forming a boundary between the base segment and the first lobe segment, (g) a second perforation forming a boundary between the base segment and the second lobe segment, and (h) a third perforation forming a boundary between the first lobe segment and the at least one protruding member of the first lobe segment; wherein the first lobe segment is connected to the base segment and the second lobe segment is connected to the base segment and opposed to the first lobe segment, wherein the first cutout segment separates the at least one protruding member of the first lobe segment from the base segment, wherein the second cutout segment separates the at least one protruding member of the second lobe segment from the base segment, wherein the label comprises at least (A) a facesheet layer and (B) an adhesive layer, each of the (A) facesheet layer and (B) adhesive layer comprising a first facial surface and a second facial surface; and wherein: the base segment is in contact with at least a portion of (i) the terminal portion of the IV port, the (b) first lobe segment is in contact with at least a portion of (ii) the tubing portion of the IV port, the (c) second lobe segment is in contact with at least a portion of (ii) the tubing portion of the IV port, and the at least one protruding member of (b) the first lobe segment and the at least one protruding member of (c) the first lobe segment are in overlapping contact such that at least a portion of the second facial surface of the adhesive layer is in contact with at least a portion of the first facial surface of the facesheet layer.

In an embodiment the invention provides a method of applying a label to an IV port wherein the IV port comprises (i) a terminal portion comprising a terminal surface and (ii) a tubing portion. According to embodiments of the present disclosure, a method of applying a label to an IV port, wherein the IV port comprises (i) a terminal portion comprising a terminal surface and (ii) a tubing portion, comprises (1) providing a label comprising (a) a base segment, (b) a first lobe segment comprising at least one protruding member and a pull tab, (c) a second lobe segment comprising at least one protruding member, (d) a first cutout segment, (e) a second cutout segment, (f) a first perforation forming a boundary between the base segment and the first lobe segment, (g) a second perforation forming a boundary between the base segment and the second lobe segment, and (h) a third perforation forming a boundary between the first lobe segment and the at least one protruding member of the first lobe segment; wherein the first lobe segment is connected to the base segment and the second lobe segment is connected to the base segment and opposed to the first lobe segment, wherein the first cutout segment separates the at least one protruding member of the first lobe segment from the base segment, wherein the second cutout segment separates the at least one protruding member of the second lobe segment from the base segment, wherein the label comprises at least (A) a facesheet layer and (B) an adhesive layer; (2) aligning the terminal surface of the IV port with the center of the base segment; (3) folding the base segment against the terminal portion of the IV port such that (A) the base segment is in partial contact with the terminal portion, (B) the first lobe segment is in contact with at least a portion of the tubing portion of the IV port, and (C) the second lobe segment is in contact with at least a portion of the tubing portion of the IV port; (4) wrapping a first of the at least one protruding members of the first lobe segment or second lobe segment around the tubing portion of the IV port; and (5) wrapping a second of the at least one protruding members of the first lobe segment or second lobe segment around the tubing portion of the IV port.

BRIEF DESCRIPTION OF THE DRAWINGS

The invention is described generally with reference to the drawings for the purpose of illustrating certain embodiments only, and not for the purpose of limiting the scope of the invention. In the drawings like numerals are used to designate like parts throughout the same.

DETAILED DESCRIPTION OF THE PREFERRED EMBODIMENT

Definitions

Figure 1:
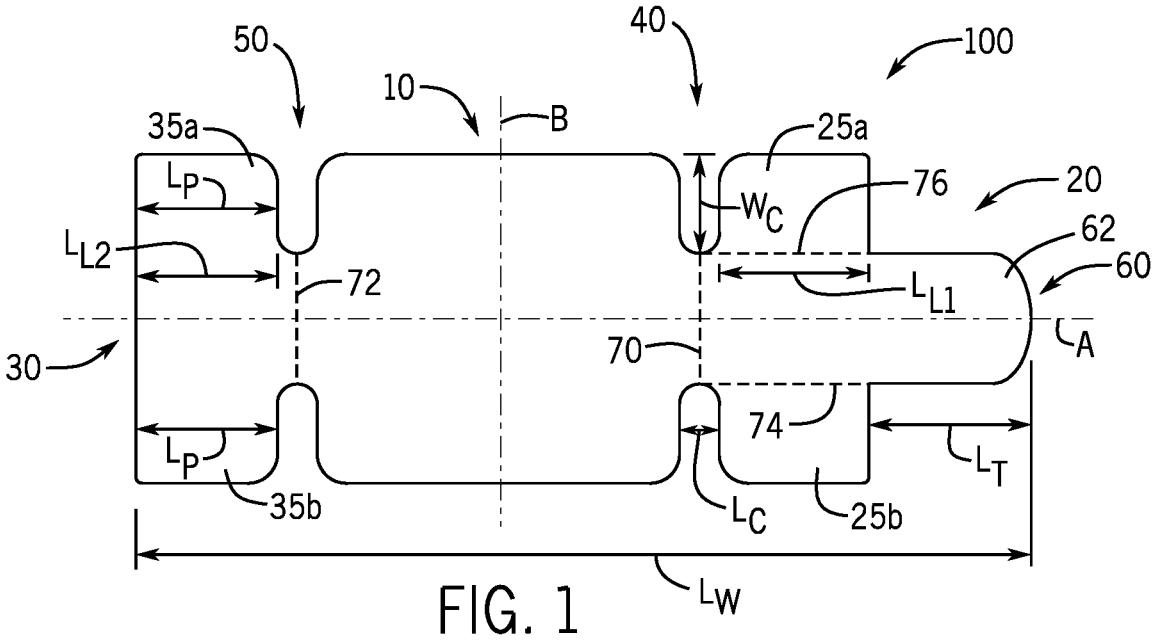
FIG. 1 is a top view of one embodiment of a label of this invention.

Unless stated to the contrary, implicit from the context, or customary in the art, all parts and percents are based on weight and all test methods are current as of the filing date of this disclosure. For purposes of United States patent practice, the contents of any referenced patent, patent application or publication are incorporated by reference in their entirety (or its equivalent US version is so incorporated by reference) especially with respect to the disclosure of definitions (to the extent not inconsistent with any definitions specifically provided in this disclosure) and general knowledge in the art.

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, layer thickness, is from 100 to 1,000, then all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, the label and layer thicknesses.

"Facial surface" and like terms are used in distinction to "edge surface". For example, if rectangular in shape or configuration, a layer, e.g., film, will comprise two opposing facial surfaces joined by four edge surfaces (two opposing pairs of edge surfaces, each pair intersecting the other pair at right angles). If circular in configuration, then the layer will comprise two opposing facial surfaces joined by one continuous edge surface.

"Ink" and like terms mean a coatable or printable formulation that can and usually does contain a dye and/or pigment.

"Dye" and like terms mean a light absorbing compound that is present in a molecularly dispersed (dissolved) form.

"Pigment" and like terms mean a visible light reflecting or absorbing material or compound that is present in a non-molecularly dispersed (particulate) form.

"Graphic", "graphic image" and like terms mean text or pictorial representations formed of ink or other dye or pigment substances. Graphics include, but are not limited to, words, numbers, bar codes, pictures, designs (geometric or otherwise), and solid colors (typically applied by flood coating).

"In contact" and like terms mean that, in the context of adjacent layers of a multilayer part, the opposing facial surfaces of adjacent layers are touching one another, e.g., such as a coating on a substrate. In other words, adjacent layers "in contact" with one another are in direct contact with no intervening layers.

Label Shape

FIGS. 1-5 illustrate exemplary embodiments of a label of the present disclosure. In the embodiments shown, the label has six main segments: a base segment 10 a first lobe segment 20, a second lobe segment 30, a first cutout segment 40, a second cutout segment 50, and a pull tab 60.

The base segment 10 is generally the largest of the segments. In an embodiment, the base segment 10 is configured to be in at least partial contact with the injection surface of an IV port. The shape of the base segment 10 can therefore vary by convenience depending on the shape, size and type of IV port and/or IV bag with which the label will be used. For example, the base segment 10 may be generally rectangular or square (e.g., such as base segments 10, 10" and 10''' shown in FIGS. 1-2 and 4-5), oval-shaped or circular (e.g., such as base segment 10' shown in FIG. 3), or any other shape, and any corners can be rounded or angled.

Similarly, the exact dimensions of the base segment 10 can vary by convenience depending on the shape, size and type of IV port and/or IV bag with which the label will be used. Preferably, the base segment 10 will have a surface area sufficient to wrap around the terminal portion 84 of an IV port 82 with some excess. Many IV bags 80, however, include a second port or other structure in proximity to an IV port being covered. It will be appreciated that, at least in some applications, large dimensions and resulting large surface area are undesirable.

In an embodiment, the length $L_B$ of the base segment 10 at its longest point is at least 30%, or at least 35%, or at least 40%, or at least 45%, or at least 50% of the total length $L_W$ of the label 100.

In an embodiment, the length $L_B$ of the base segment 10, at its longest point, is approximately from 1.25×, or from 1.5×, or from 1.75×, or from 2.0× to 3.0×, or to 2.75×, or to 2.5× or 2.25×, or to 2.0× the length of the terminal portion 84 of an IV port 82. In an embodiment, the width $W_B$ of the base segment 10, at its widest point, is approximately from 1.5, or from 2×, or from 3×, or from 4×, or from 5×, or from 6×, or from 7×, or from 8×, or from 9×, or from 10× to 12×, or to 11×, or to 10×, or to 9×, or to 8×, or to 7×, or to 6×, or to 5×, or to 4×, or to 3× the radius of the terminal portion 84 of an IV port 82.

In an embodiment, the length $L_B$ of the base segment 10 at its longest point is from approximately 0.50 inches, or from 0.75 inches, or from 0.80 inches, or from 0.90 inches, or from 1.0 inches, or from 1.10 inches, or from 1.15 inches, or from 1.20 inches, or from 1.25 inches, or from 1.30 inches, or from 1.5 inches, or from 1.75 inches to 3.0 inches, or to 2.75 inches, or to 2.5 inches, or to 2.25 inches, or to 2.0 inches, or to 1.75 inches, or to 1.5 inches, or to 1.45 inches, or to 1.40 inches, or to 1.35 inches, or to 1.30 inches, or to 1.25 inches.

In an embodiment, the length $L_B$ of the base segment 10 at its longest point is 1.125 inches.

In an embodiment, the width $W_B$ of the base segment 10, at its widest point, is approximately equal to, or +/−1%, or +/−2%, or +/−3%, or +/−4%, or +/−5%, or +/−10%, or +/−15% of the length $L_B$ of the base segment 10 at its longest point. In an embodiment, the length $L_B$ of the base segment 10 at its longest point is greater than or equal to the width $W_B$ of the base segment 10 at its widest point.

In an embodiment, the width $W_B$ of the base segment 10 at its widest point is from approximately 0.50 inches, or from 0.75 inches, or from 0.80 inches, or from 0.90 inches, or from 1.0 inches, or from 1.10 inches, or from 1.15 inches, or from 1.20 inches, or from 1.25 inches, or from 1.30 inches, or from 1.5 inches, or from 1.75 inches to 3.0 inches, or to 2.75 inches, or to 2.5 inches, or to 2.25 inches, or to 2.0 inches, or to 1.75 inches, or to 1.5 inches, or to 1.45 inches, or to 1.40 inches, or to 1.35 inches, or to 1.30 inches, or to 1.25 inches.

In an embodiment, the $W_B$ of the base segment 10 at its widest point is 1.00 inches.

In a particularly preferred embodiment, the base segment 10 has a surface area of at least 0.75 $in^2$, or at least 0.8 $in^2$, or at least 0.85 $in^2$, or at least 0.90 $in^2$, or at least 0.95 $in^2$, or at least 1.0 $in^2$. Further, in a preferred embodiment, the base segment 10 is symmetric along at least one of, and more preferably both of, axes A and B, as identified in FIGS. 1 and 3-5.

In an embodiment, the base segment 10 is square, as shown in FIGS. 1-2 and 4-5. In a specific embodiment, the base segment 10 is square and has a length and width of 1 inch, resulting in a surface area of 1 $in^2$.

In the embodiments shown, the corners of the base segment 10 are rounded. While any corners to the base segment 10 can be rounded or angled, the corners will preferably be rounded to avoid puncturing the gloves of medical personal handling the label and/or IV bag. In a preferred embodiment, such as shown in FIGS. 1-5, the corners of the base segment 10 are curved at a radius of from greater than 0.000 inches, or from 0.010 inches, or from 0.020 inches, or from 0.030 inches, or from 0.040 inches, or from 0.050 inches, or from 0.060 inches, or from 0.070 inches, or from 0.080 inches to 0.150 inches, or to 0.140 inches, or to 0.130 inches, or to 0.120 inches. In a specific embodiment, the corners of the base segment are curved at a radius of 0.0938 inches.

Figure 2:
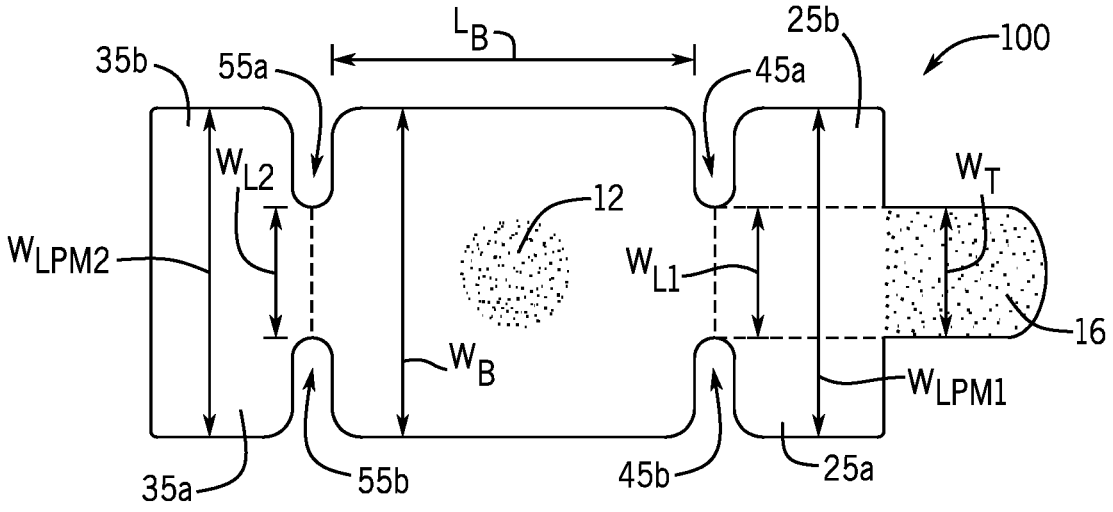
FIG. 2 is a bottom view of the label of FIG. 1.
Figure 3:
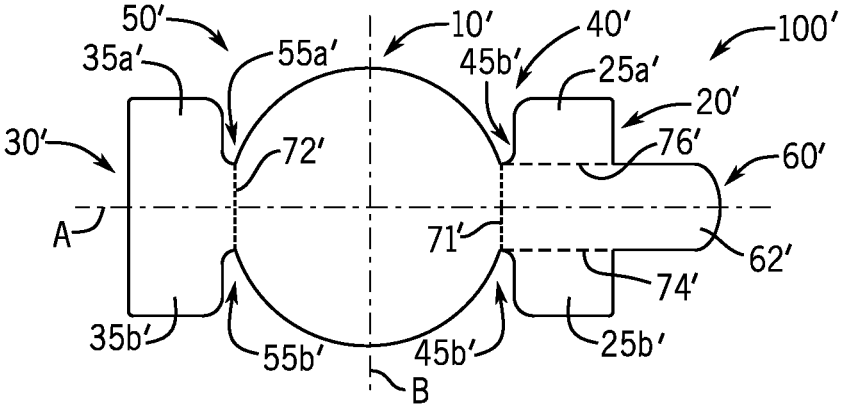
FIG. 3 is a top view of a second embodiment of a label of this invention.
Figure 4:
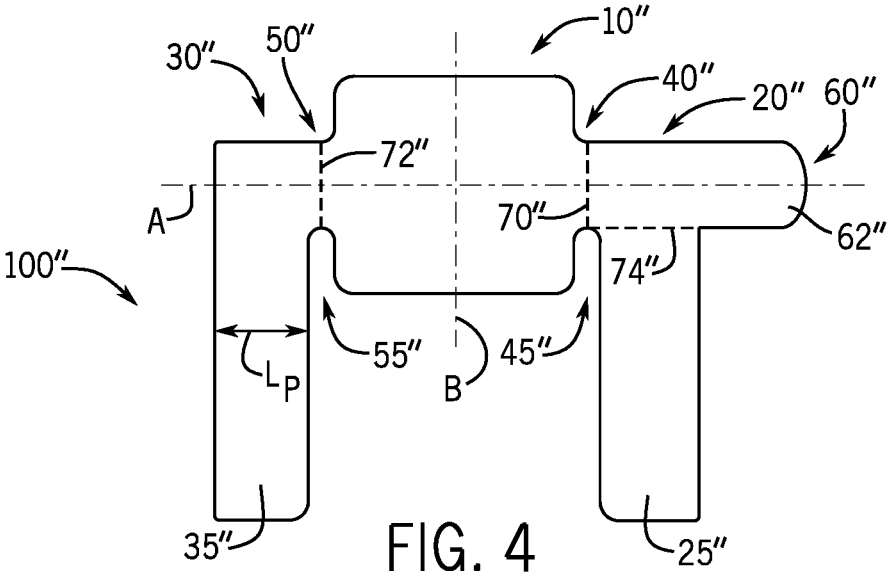
FIG. 4 is a top view of a third embodiment of a label of this invention.
Figure 5:
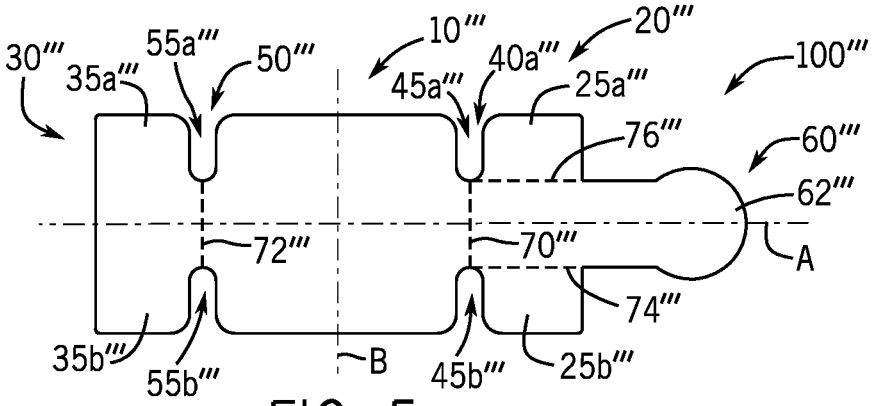
FIG. 5 is a top view of a fourth embodiment of a label of this invention.

While the base segment is primarily described above with reference to base segment 10 of FIGS. 1-2, it will be understood that similar description is applicable to the various base segments 10', 10" and 10''' shown in FIGS. 3-5 unless stated to the contrary.

As shown in FIGS. 1-5, the first and second lobe segments 20, 30 (respectively) are connected to the base segment 10 on opposite sides of the base segment 10. Generally, each lobe segment 20, 30 includes at least one protruding member. For example, FIG. 4 shows the lobe segments 20",30" each having a single protruding member 25",35", respectively, while FIGS. 1-3 and 5 show the lobe segments 20, 30 (and 20',30' and 20', 30''') as each having a pair of protruding members 25*a*, 25*b* and 35*a*, 35*b* (and 25*a*', 25*b*' and 35*a*', 35*b*' and 25*a*''', 25*b*''' and 35*a*''', 35*b*''').

The lobe segments 20, 30 are designed to wrap around the tubing portion 88 of an IV port 82, with the protruding member(s) 25, 35 of each of the lobe segments 20, 30 designed to overlap at least with one of (a) the other lobe segment, (b) a protruding member of the other lobe segment, (c) the lobe segment to which the protruding member is attached, (d) itself, and (e) another protruding member of the same lobe segment, depending on the particular design of the lobe segments. By overlapping at least a portion of the label, the adhesive layer is in contact with not only the surface of the IV port, but also the outer surface of the facesheet layer of the label. In instances when a contaminant is on the surface of the IV port which may negatively impact the ability of the adhesive to adhere to the IV port (e.g., IPA), the overlapping portion will not be affected. In other words, by virtue of the overlap, the risk of premature disengagement of the label and IV port caused by lowered adhesion to the IV port itself is mitigated.

It will be understood that the shape of the lobe segments 20, 30 and their corresponding protruding member(s) 25, 35 can therefore vary by convenience depending on the shape, size and type of IV port, particularly the tubing portion of the IV port, and/or IV bag with which the label will be used. For example, the lobe segments 20, 30 and protruding members 25, 35 can each, independently, be rectangular or square (as shown in FIGS. 1-5), oval-shaped or circular, triangular or any other shape. Similarly, the number of protruding members 25, 35 associated with the respective lobe segment 20, 30 may vary. For example, FIG. 4 shows lobe segments 20",30" each containing a single associated protruding member (25", 35"), while FIGS. 1-3 and 5 show lobe segments 20, 30 each contain a pair of protruding members (25*a*, 25*b* and 35*a*, 35*b*, respectively). In other embodiments, each lobe segment 20, 30 can independently include one, two, three, four or more protruding members.

Moreover, in order to contact the tubing portion 88 of an IV port 82 and accomplish the necessary overlap, each of the protruding members must extend from the respective lobe segment 20, 30 at an angle which is not parallel to an axis A. It will be appreciated that while the angle can vary, it must vary within reason and is dependent on the overall shape and configuration of the lobe segments 20, 30 and protruding members 25, 35 so that the necessary overlap is accomplished.

In an exemplary embodiment, as described with reference to FIG. 4, the first lobe segment 20" has a generally rectangular shape with a single protruding member 25" extending outward at an angle not parallel with an axis A. Similarly, the second lobe segment 30" has a generally rectangular shape with a single protruding member 35" extending outward at an angle not parallel with an axis A. More preferably, the protruding members 25", 35" extend generally perpendicularly from the respective lobe segments 20", 30". Moreover, while the protruding members 25", 35" of the embodiment shown in FIG. 4 both extend outward from the lobe segments 20",30" on the same side of the label 100", in other embodiments, the protruding members 25", 35" can extend outwardly from the lobe segments 20", 30" on different or opposite sides of the label 100".

In the embodiment shown in FIG. 4, the protruding members 25",35" are generally rectangular. Although the edges of the lobe segments 20",30" and protruding members 25",35" are shown as rounded, the edges can also be angled.

In another exemplary embodiment, as shown in FIGS. 1-3 and 5, the first lobe segment 20 has a generally rectangular shape with a pair of opposed protruding members 25*a*, 25*b* each extending outward at an angle not parallel with an axis A. Similarly, the second lobe segment 30 has a generally rectangular shape with a pair of opposed protruding members 35*a*, 35*b* each extending outward at an angle not parallel with axis A. More preferably, the protruding members 25*a*, 25*b*, 35*a*, 35*b* extend generally perpendicularly from the respective lobe segments 20, 30. Moreover, while each of the respective protruding members 25*a*, 25*b* and 35*a*, 35*b* are shown to be extending from their respective lobe segment 20, 30 in a manner such that the label at the lobe segments 20, 30 is generally symmetrical along axis A, it is understood that the protruding members 25*a*, 25*b* and 35*a*, 35*b* may be positioned such that the label at the lobe segments 20, 30 is not generally symmetrical.

It will be appreciated that, with respect to the dimensions of the lobe segments 20, 30 and protruding members 25, 35, the total width of the lobe segments 20, 30 and their respective protruding members 25, 35 will vary by convenience depending on the overall shape and configuration of the label 100 and the medical device to which the label 100 is affixed, provided at least one of the protruding member(s) 25, 35 of at least one of the respective lobe segments 20, 30 overlaps at least with one of (a) the other lobe segment, (b) a protruding member of the other lobe segment, (c) the lobe segment to which the protruding member is attached, (d) itself, and (e) another protruding member of the same lobe segment, depending on the particular design of the lobe segments. For example, it will be appreciated that, if the protruding members 25, 35 are generally perpendicular to their respective lobe segments 20, 30, the overall length of the protruding members 25, 35 (as measured perpendicular to axis A) does not need to be as great as the width of a protruding member which extends from a lobe segment at an angle other than perpendicular to the axis A in order to accomplish at least one of the above overlaps. However, the overall width of a protruding member which extends from a lobe segment at an angle other than perpendicular to axis A, as measured from the point on the protruding member which is furthest from axis A to the closest boundary of the respective lobe segment if such boundary was extended in a direction parallel with the axis A, can be similar to or the same as the overall length of the protruding members 25, 35 (as measured perpendicular to axis A) when the protruding members 25, 35 extend perpendicular to the axis A.

Therefore, in the embodiments described herein, the width of a protruding member is measured from the point on the given protruding member which is furthest from axis A to the closest boundary of the respective lobe segment if such boundary was extended in a direction parallel with axis A. In the specific embodiments shown in the Figures, wherein each protruding member 25, 35 extends from its respective lobe segment 20, 30 at an angle perpendicular to axis A, the width of a protruding member is measured from the point of the protruding member furthest from axis A to the closest boundary of the corresponding lobe segment 20, 30 as determined by the cutout segments 40, 50, described in further detail below.

In an embodiment, the total width of each lobe segment 20, 30 and their respective protruding member(s) 25 and 35 ($W_{LPM1}$, $W_{LPM2}$), is from 50%, or from 60%, or from 70%, or from 80%, or from 90%, or from 100%, or from 110%, or from 120%, or from 130%, or from 140%, or from 150% to 200%, or to 190%, or to 180%, or to 170%, or to 160%, or to 150%, or to 140%, or to 130%, or to 120%, or to 110%, or to 100% of the width $W_B$ of the base segment 10.

In the exemplary embodiments shown, the total width of each lobe segment 20, 30 and their respective protruding member(s) 25 and 35 ($W_{LPM1}$, $W_{LPM2}$) is from at least 0.5 inches, or from 0.6 inches, or from 0.7 inches, or from 0.75 inches, or from 0.80 inches, or from 0.90 inches, or from 1.0 inches, or from 1.10 inches, or from 1.15 inches, or from 1.20 inches, or from 1.25 inches, or from 1.30 inches, or from 1.5 inches, or from 1.75 inches to 3.0 inches, or to 2.75 inches, or to 2.5 inches, or to 2.25 inches, or to 2.0 inches, or to 1.75 inches, or to 1.5 inches, or to 1.45 inches, or to 1.40 inches, or to 1.35 inches, or to 1.30 inches, or to 1.25 inches.

In an embodiment, the total width of each lobe segment 20, 30 and their respective protruding member(s) 25 and 35 ($W_{LPM1}$, $W_{LPM2}$) is 1.00 inches.

In the exemplary embodiments shown in which the label 100 is to be affixed to an IV port 82, the total width of the two lobe segments 20, 30 and their respective protruding member(s) 25, 35 combined (i.e., $W_{LPM1}+W_{LPM2}$) must be at least greater than the circumference of the tubing portion 88 of the IV port 82.

In an embodiment, the width $W_{LPM1}$ of the first lobe segment 20 and its respective protruding member(s) 25 is at least greater than 50%, or greater than 60%, or greater than 70%, or greater than 75% to less than 100%, or to less than 95%, or to less than 90%, or to less than 85% of the circumference of the tubing portion 88 of the IV port 82 and the width $W_{LPM2}$ of the second lobe segment 30 and its respective protruding member(s) 35 is at least greater than 50%, or greater than 60%, or greater than 70%, or greater than 75% to less than 100%, or to less than 95%, or to less than 90%, or to less than 85% of the circumference of the tubing portion 88 of the IV port 82. As will be appreciated, the width of each of the lobe segments and their respective protruding member(s) can be the same or different.

In an embodiment, the lengths of the first and second lobe segments, $L_{L1}$ and $L_{L2}$, respectively, are each independently from less than or equal to the length $L_B$ of the base segment 10, or less than or equal to 90% of the length of the base segment 10, or less than or equal to 80% of the length of the base segment 10, or less than or equal to 70% of the length of the base segment 10, or less than or equal to 60% of the length of the base segment 10, or less than or equal to 50% of the length of the base segment 10, or less than or equal to 40% of the length of the base segment 10. The lengths of the lobe segments $L_{L1}$, $L_{L2}$ can be the same or different.

In an embodiment, the lengths of the first and second lobe segments, $L_{L1}$ and $L_{L2}$, respectively, are each independently from 0.3 inches, or from 0.5 inches, or from 1.0 inch to 3.0 inches, or to 2.5 inches, or to 2.0 inches, or to 1.5 inches.

In a specific embodiment, as shown in FIGS. 1-5, the length of the first lobe segment $L_{L1}$ is approximately from 0.3 inches, or 0.325 inches, or 0.35 inches, or 0.375 inches, or 0.4 inches, or 0.425 inches to 0.6 inches, or 0.575 inches, or 0.55 inches, or 0.525 inches, or 0.5 inches, or 0.475 inches or 0.45 inches and the length of the second lobe segment $L_{L2}$ is approximately from 0.3 inches, or 0.325 inches, or 0.35 inches, or 0.375 inches, or 0.4 inches, or 0.425 inches to 0.6 inches, or 0.575 inches, or 0.55 inches, or 0.525 inches, or 0.5 inches, or 0.475 inches or 0.45 inches. More particularly, in a specific embodiment, the length of the first lobe segment $L_{L1}$ is 0.4375 inches and the length of the second lobe segment $L_{L2}$ is 0.4375 inches.

In an embodiment, the widths of the first and second lobe segments, $W_{L1}$ and $W_{L2}$, respectively, are each independently from greater than or equal to 15%, or greater than or equal to 20%, or greater than or equal to 25%, or greater than or equal to 30%, or greater than or equal to 35% of the width of the base segment 10 to less than or equal to 100%, or less than or equal to 90%, or to less than or equal to 80%, to less than or equal to 70%, to less than or equal to 60%, to less than or equal to 50% of the width $W_B$ of the base segment 10. The width of the lobe segments $W_{L1}$, $W_{L2}$ can be the same or different.

In a specific embodiment, as shown in FIGS. 1-5, the width of the first lobe segment $W_{L1}$ is approximately from 0.25 inches, or from 0.275 inches, or from 0.3 inches, or from 0.325 inches, or from 0.35 inches, or from 0.375 inches, or from 0.4 inches to 0.75 inches, or to 0.7 inches, or to 0.65 inches, or to 0.6 inches, or to 0.55 inches, or to 0.5 inches, or to 0.45 inches, or to 0.4 inches and the width of the second lobe segment $W_{L2}$ is approximately from 0.25 inches, or from 0.275 inches, or from 0.3 inches, or from 0.325 inches, or from 0.35 inches, or from 0.375 inches, or from 0.4 inches to 0.75 inches, or to 0.7 inches, or to 0.65 inches, or to 0.6 inches, or to 0.55 inches, or to 0.5 inches, or to 0.45 inches, or to 0.4 inches. More particularly, in a specific embodiment, the width of the first lobe segment $W_{L1}$ is 0.375 inches and the length of the second lobe width $W_{L2}$ is 0.375 inches.

It will be understood that the length of the protruding members 25, 35 can vary depending on the shape and angle at which the protruding members 25, 35 extend from the lobe segments 20, 30. However, generally, the length of the protruding members Lp, as measured at any point along the protruding member(s) in a direction parallel with the axis A is from 50%, or from 60% or from 70% or from 80% or from 90% to 150%, or to 140%, or to 130%, or to 120%, or to 110%, or to 100% of the length of the corresponding lobe segment $L_{L1}$, $L_{L2}$.

In a particularly preferred embodiment, and as shown with reference to FIGS. 1-5, the lobe segments 20, 30 each have one or two associated protruding members 25 (or 25*a*, 25*b*), 35 (or 35*a*, 35*b*), with each of the protruding members being generally rectangular and extending from the respective lobe segment 20, 30 at an angle generally perpendicular to the axis A, the length Lp of the protruding members 25 (or 25*a*, 25*b*), 35 (or 35*a*, 35*b*) is approximately equal to the length $L_{L1}$, $L_{L2}$ of the corresponding lobe segment 20, 30. That is, in the preferred embodiments shown in FIGS. 1-5, the length Lp of each of the protruding members is approximately from 0.3 inches, or 0.325 inches, or 0.35 inches, or 0.375 inches, or 0.4 inches, or 0.425 inches to 0.6 inches, or 0.575 inches, or 0.55 inches, or 0.525 inches, or 0.5 inches, or 0.475 inches or 0.45 inches. More preferably, the length of each of the protruding members is 0.4375 inches.

In the embodiments shown, the corners of the lobe segments 20, 30 and protruding members 25, 35 are rounded. Particularly, the corners of the protruding members 25, 35 closest to the base segment 10 are rounded at a first radius while the corners of the protruding members 25, 35 furthest from the base segment 10 are rounded at a second, greater, radius. While any lobe segments 20, 30 and protruding members 25, 35 can be rounded or angled, the corners will preferably be rounded to avoid puncturing the gloves of medical personal handling the label and/or IV bag.

In a preferred embodiment, such as shown in FIGS. 1-5, the corners of the lobe segments 20, 30 and protruding members 25, 35 are curved at a radius of from greater than 0.000 inches, or from 0.005 inches, or from 0.010 inches, or from 0.015 inches, or from 0.020 inches, or from 0.030 inches, or from 0.040 inches, or from 0.050 inches, or from 0.060 inches, or from 0.070 inches, or from 0.080 inches to 0.150 inches, or to 0.140 inches, or to 0.130 inches, or to 0.120 inches, or to 0.100 inches, or to 0.090 inches, or to 0.080 inches, or to 0.070 inches, or to 0.060 inches, or to 0.050 inches, or to 0.040 inches, or to 0.030 inches, or to 0.025 inches, or to 0.020 inches, or to 0.018 inches. In the specific embodiment, the corners of the protruding members 25, 35 closest to the base segment 10 are curved at a radius of from 0.020 inches, or from 0.030 inches, or from 0.040 inches, or from 0.050 inches, or from 0.060 inches, or from 0.070 inches, or from 0.080 inches to 0.150 inches, or to 0.140 inches, or to 0.130 inches, or to 0.120 inches and the corners of the protruding members 25, 35 furthest from the base segment 10 are curved at a radius of from greater than 0.000 inches, or from 0.005 inches, or from 0.010 inches, or from 0.015 inches to 0.025 inches, or to 0.020 inches or to 0.018 inches. In a specific embodiment, the corners of the protruding members 25, 35 closest to the base segment 10 are curved at a radius of 0.0938 and the corners of the protruding members 25, 35 furthest from the base segment 10 are curved at a radius of 0.0156.

While the lobe segments and protruding members are primarily described above with reference to first lobe segment 20, second lobe segment 30 and their respective protruding members 25*a*, 25*b* and 35*a*, 35*b* as shown in FIGS. 1-2, it will be understood that similar description is applicable to the various first lobe segments 20',20", 20'", the various second lobe segments 30',30", 30'", and the various respective protruding members 25*a*', 25*b*', 35*a*', 35*b*', 25", 35", 25*a*'", 25*b*'", 35*a*'", and 35*b*'" as shown in FIGS. 3-5 unless stated to the contrary.

In embodiments, the label 100 also includes a first cutout segment 40 and a second cutout segment 50. The cutout segments 40, 50 separate the protruding member(s) 25 and protruding member(s) 35, respectively, from the base segment 10. In other words, cutout segments 40, 50 permit the protruding members to move independently from the base segment 10, as discussed in further detail below.

Turning again to FIG. 4, each cutout segment 40",50" is shown as having a single cutout portion 45",55" corresponding to a respective one of the single protruding members 25",35" of the respective lobe segment 20",30". Because each lobe segment 20",30" includes a single protruding member 25",35", only a single cutout portion 45",55" is needed for each cutout segment 40",50". In contrast, turning to FIGS. 1-3 and 5, each cutout segment 40, 50 (and 40',40'" and 50',50'") includes a pair of cutout portions 45*a*, 45*b* and 55*a*, 55*b* (and 45*a*', 45*b*' and 55*a*', 55*b*' and 45*a*'", 45*b*'" and 55*a*'", 55*b*"), each corresponding to a respective one of the protruding members 25*a*, 25*b* and 35*a*, 35*b* (and 25*a*', 25*b*' and 35*a*', 35*b*' and 25*a*'", 25*b*'" and 35*a*'", 35*b*'") to separate the protruding member from the base segment 10 (and 10' and 10'").

In each of the embodiments shown, the cutout portions 45, 55 are shown as approximately rectangular and being approximately perpendicular to the axis A. It will be understood, however, that the shape, configuration and orientation of each of the cutout portions 45, 55 will depend on the particular shape and arrangement of the protruding members 25, 35 and the shape of the base member 10. For example, if a base member is round (10') and a protruding member is rectangular (25*a*', 25*b*', 35*a*', 35*b*'), the corresponding cutout portion will have more of a triangle-like shape with one leg having a contour matching that of the rounded base member as shown in FIG. 3.

As described above, the protruding member(s) 25, 35 of each lobe segment 20, 30 are designed to each, independently, wrap around at least a portion of the circumference of the tubing portion 88 of an IV port 82. Each cutout portion 45, 55 of the cutout segments 40, 50 must therefore have a width $W_C$ great enough to permit such wrapping.

It will be appreciated that the dimensions and shape of the cutout portions 45, 55 of the cutout segments 40, 50 will vary by convenience depending on the overall shape and configuration of the label 100, and particularly the shape and configuration of the protruding members 25, 35. For example, if the protruding members 25, 35 and base segment 10 are generally square and/or rectangular, with the protruding members 25, 35 extending at an angle perpendicular to the axis A, the cutout portions 45, 55 will be generally square and/or rectangular with a width $W_C$ approximately equal to the width of the corresponding protruding member (25, 35) as measured perpendicular to the axis A. However, in embodiments in which the protruding members 25, 35 and/or base segment 10 is not rectangular/square and/or the protruding members 25, 35 extend at an angle other than perpendicular to the axis A, the cutout portions 45, 55 will have geometries and dimensions which correspond to the geometries and dimensions of the base segment 10 and protruding members 25, 35. Moreover, depending on the specific geometries and dimensions of the cutout portions 45, 55, the width of a cutout portion, as measured at an angle other than perpendicular to axis A may be greater than a width of the same cutout portion as measured perpendicular to axis A.

Therefore, in the embodiments described herein, the width of a cutout portion is to be considered as measured from the point of the given cutout portion which is furthest from axis A to the point at which the cutout portion meets either the base or corresponding lobe portion (whichever is closest to axis A) if a line is drawn passing through that point parallel with axis A.

In an embodiment, the cutout portion(s) 45, 55 of each cutout segment 40, 50 have a width $W_C$ of from approximately 25% to less than 50% of the total width $W_L$ of the respective lobe segment 20, 30 and the lobe segment's corresponding protruding member(s) 25, 35.

In a particular embodiment, such as shown in FIGS. 1-5, in which each of the protruding members 25, 35 extends approximately perpendicular to the axis A, each of the cutout portions has a width $W_C$ of from 0.25 inches, or from 0.26 inches, or from 0.27 inches, or from 0.28 inches, or from 0.29 inches, or from 0.30 inches to less than 0.50 inches, or to less than 0.45 inches, or to less than 0.4 inches, or to less than 0.35 inches. In a specific embodiment, each of the cutout portions has a width $W_C$ of 0.3125 inches.

Moreover, each of the cutout portions must create sufficient clearance between the respective protruding member and the base segment to permit the protruding members to wrap around the tubing portion 88 of an IV port 82. In a particular embodiment, the length $L_C$ of the each of the cutout portions is from approximately 15% to less than 50% of the width $W_C$ of the respective cutout portion. Preferably, the length $L_C$ of each of the cutout portions is approximately from 15%, or from 20%, or from 25%, or from 30%, or from 35%, or from 40% to less than 50%, or to 45%, or to 40% or to 35% of the width $W_C$ of the respective cutout portion.

For example, in the embodiments shown in FIGS. 1-5, in which each of the protruding members 25, 35 extends approximately perpendicular to the axis A, and each of the cutout portions has a width $W_C$ of from 0.25 inches to less than 0.5 inches, the cutout portions have a length $L_C$ of from 0.0375 inches to less than 0.25 inches. In a specific embodiment, each of the cutout portions has a width $W_C$ of 0.3125 inches and a length $L_C$ of 0.125 inches (or 40% of $W_C$).

In an embodiment, and as shown in FIGS. 1-5, the inner edges of the cutout portions 45, 55 are rounded. However, in further embodiments, the inner edges of the cutout portions 45, 55 may be angled. In the embodiments shown, the inner edges of the cutout portions 45, 55 are curved at a radius of from 0.030 inches, or from 0.035 inches, or from 0.040 inches, or from 0.045 inches, or from 0.050 inches, or from 0.055 inches, or from 0.060 inches to 0.100 inches, or to 0.095 inches, or to 0.090 inches, or to 0.085 inches, or to 0.080 inches, or to 0.075 inches, or to 0.070 inches, or to 0.065 inches. In a specific embodiment, the inner edges of the cutout portions 45, 55 are rounded at a radius of 0.0625 inches.

While the cut out segments and corresponding cutout portions are primarily described above with reference to the first cutout segment 40, the second cutout segment 50 and their respective cutout portions 45*a*, 45*b* and 55*a*, 55*b* as shown in FIGS. 1-2, it will be understood that similar description is applicable to the various first cutout segments 40',40",40'", the various second cutout segments 50',50", 50'" and the various respective cutout portions 45*a*', 45*b*', 55*a*', 55*b*', 45",55", 45*a*'", 45*b*'", 55*a*'" and 55*b*'" as shown in FIGS. 3-5 unless stated to the contrary.

The label 100 further includes a pull tab 60 which is integrally associated with one of the lobe segments 20, 30. In the embodiments shown, the pull tab 60 is part of the first lobe segment 20 and has a generally rectangular shape with a rounded free end 62. As discussed in further detail below, the pull tab 60 is used initiate a tear in the perforations (described below) when removing the label 100 from the terminal part 84 of an IV port 82.

While the pull tab 60 shown in the Figures is rectangular with a rounded free end 62, it will be appreciated that the shape of the pull tab 60 can vary by convenience. For example, the pull tab 60 can be generally circular, square, oval-shaped or any shape which can be grasped by a healthcare worker. Similarly, the shape and configuration of the free end 62 can vary by convenience. For example, in the embodiments shown in FIGS. 1-4, the free end 62 (and 62',62") is rounded and in FIG. 5 the free end 62'" is circular. In a preferred embodiment, the free end 62 will have smooth or rounded edges (e.g., not angled) to decrease the chance of the label 100 puncturing a healthcare worker's gloves while using or removing the label 100.

In an embodiment, the pull tab 60 has a width $W_T$ of from less than 50%, or from less than 45%, or from less than 40% of the circumference of the tubing portion 88 of an IV port 82 to greater than 25%, or greater than 30%, or greater than 35% of the circumference of the tubing portion 88 of an IV port 82. More specifically, in the embodiments shown in FIGS. 1-5, the pull tab has a width $W_T$ of approximately from 0.25 inches, or from 0.275 inches, or from 0.3 inches, or from 0.325 inches, or from 0.35 inches, or from 0.375 inches, or from 0.4 inches to 0.75 inches, or to 0.7 inches, or to 0.65 inches, or to 0.6 inches, or to 0.55 inches, or to 0.5 inches, or to 0.45 inches, or to 0.4 inches. In a specific embodiment, the width $W_T$ of the pull tab 60 is 0.375 inches.

In an embodiment, the pull tab 60 has a length $L_T$ of from less than 80%, or from less than 75%, or from less than 70%, or from less than 65%, or from less than 60% of the length $L_B$ of the base segment 10 to greater than 25%, or greater than 30%, or greater than 40%, or greater than 45%, or greater than 50% of the length $L_B$ of the base segment 10. In a particular embodiment, such as shown with reference to FIGS. 1-5, the pull tab 60 has a length $L_T$ of from 0.3 inches, or from 0.35 inches, or from 0.4 inches, or from 0.45 inches, or from 0.5 inches to 0.8 inches, or to 0.75 inches, or to 0.7 inches, or to 0.65 inches, or to 0.6 inches, or to 0.55 inches, or to 0.5 inches. In a specific embodiment, the length $L_T$ of the pull tab 60 is 0.5 inches.

While the pull tab and its free end are primarily described above with reference to the pull tab 60 and free end 62 as shown in FIGS. 1-2, it will be understood that similar description is applicable to the various pull tabs 60',60" and 60'" and corresponding free ends 62',62" and 62'" as shown in FIGS. 3-5 unless stated to the contrary.

In accordance with embodiments of the present disclosure, the label 100 also includes a first perforation 70, a second perforation 72, a third perforation 74 and, optionally, a fourth perforation 76 depending on the configuration of the lobe segments 20, 30 and their protruding member(s) 25, 35. Particularly, in the embodiment shown, a first perforation 70 forms a boundary between the base segment 10 and the first lobe segment 20, extending the width of the first lobe segment 20, and a second perforation 72 forms a boundary between the base segment 10 and the second lobe segment 30, extending the width of the second lobe segment 30.

The third and optional fourth perforations 74, 76 are positioned with respect to the lobe segment on which the pull tab 60 is formed. In the embodiments shown in FIGS. 1-5, the pull tab 60 is formed on the first lobe segment 20, and the following passages will describe the third and optional fourth perforations 74, 76 with respect to the first lobe segment 20. However, it will be understood that the third and optional fourth perforations 74, 76 may be positioned with respect to the second lobe segment 30, depending on positioning of the pull tab 60, and the same description will apply.

In the embodiment shown in FIGS. 1-5, the third and optional fourth perforations 74, 76 are positioned with respect to the first lobe segment 20. Particularly, in the embodiment shown in FIG. 4 in which the first lobe segment 20" includes a single protruding member 25", the third perforation 74" forms a boundary between the protruding member 25" and the first lobe segment 20", extending the length of the first lobe segment 20" and protruding member 25" at the location the protruding member 25" joins with the first lobe segment 20". In embodiments such as shown in FIGS. 1-3 and 5 in which the first lobe segment 20 (and 20',20'") includes a pair of protruding members 25*a*, 25*b* (and 25*a*', 25*b*' and 25*a*'", 25*b*"), the third perforation 74 (and 74' and 74'") forms a boundary between one of the protruding members (e.g., the first protruding member 25*a*, 25*a*', 25*a*'" in the embodiment shown in FIGS. 1-3 and 5) and the first lobe segment 20 (and 20' and 20'"), and the optional fourth perforation 76 (and 76' and 76'") is present to form a boundary between the other of the protruding members (e.g., the second protruding member 25*b*, 25*b*', 25*b*'" in the embodiment shown in FIGS. 1-3 and 5) and the first lobe segment 20 (and 20' and 20'").

While the first, second, third and optional fourth perforations are primarily described above with reference to the first perforation 70, second perforation 72, third perforation 74 and optional fourth perforation 76 as shown in FIGS. 1-2, it will be understood that similar description is applicable to the various first perforations 70',70" and 70'", the various second perforations 72',72" and 72'", the various third perforations 74',74" and 74'" and the various optional fourth perforations 76' and 76'" of FIGS. 3-5 unless stated to the contrary.

In an embodiment, the total length ($L_W$) of the label 100, i.e., $L_B+L_{L1}+L_{L2}+L_T$, can vary depending on the medical device (e.g., IV bag, syringe, etc.) with which the label will be used. In an embodiment, the total length ($L_W$) of the label 100 is from 1.0 inch, or from 2.0 inches, or from 3.0 inches, or from 4.0 inches, or from 5.0 inches, or from 6.0 inches to 10 inches, or to 9.0 inches, or to 8.0 inches, or to 7.0 inches, or to 6.0 inches, or to 5.0 inches, or to 4.0 inches.

In a particular embodiment in which the label 100 is configured to be affixed to an IV port, the total length $L_W$ of the label 100 is from 1.0 inches, or from 1.25 inches, or from 1.5 inches, or from 1.75 inches, or from 2.0 inches, or from 2.25 inches, or from 2.5 inches, or from 2.75 inches, or from 3.0 inches, or from 3.25 inches, or from 3.5 inches, or from 3.75 inches, or from 4.0 inches to 6.0 inches, or to 5.75 inches, or to 5.5 inches, or to 5.25 inches, or to 5.0 inches, or to 4.75 inches, or to 4.5 inches, or to 4.25 inches, or to 4.0 inches, or to 3.75 inches, or to 3.5 inches, or to 3.25 inches, or to 3.0 inches.

In an embodiment, the label is a single, integrally-formed structure with the lobe segments 20, 30 formed and integral with the base segment 10 and the protruding member(s) 25, 35 of each of the lobe segments 20, 30 formed and integral with the corresponding lobe segment 20, 30. Likewise, the pull tab 60 is formed and integral with the lobe segment 20, 30 with which it is associated. Although the perforations form boundaries between the various portions of the label 100, these perforations do not completely disassociate the individual sections of the label until such time as a tear is propagated along one or more of the perforations.

Label Components

In an embodiment, the present disclosure provides a label 100. In an embodiment, the label 100 is an IV port label.

In an embodiment, the label 100 is a multi-layer structure comprising two or more layers. In an embodiment, the two or more layers include a facesheet layer 110 and an adhesive layer 120, as described more fully below. Other optional layers include, but are not limited to, a release ink layer 130, a primecoat ink layer 140 and/or a topcoat layer 160.

Figure 6:
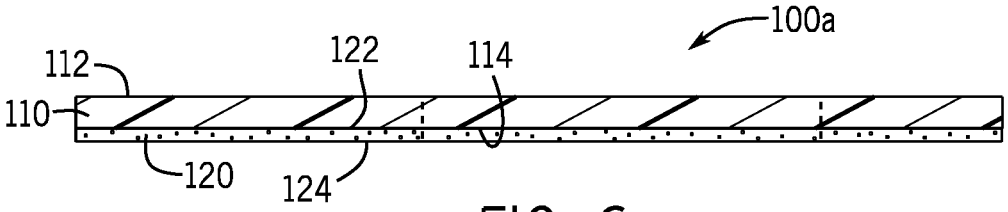
FIG. 6 is a schematic side view cross-section of an embodiment of a label of this invention having two layers.

FIG. 6 shows a schematic side view cross-section of one embodiment of a label 100*a*. Label 100*a* includes two layers: a facesheet layer 110 and an adhesive layer 120. The facesheet layer 110 includes a first facial surface 112 which is exposed and a second facial surface 114. The adhesive layer 120 includes a first facial surface 122, which is in contact with the second facial surface 114 of the facesheet layer, and a second facial surface 124. The composition of the facesheet layer 110 and adhesive layer 120 can be as described herein.

The adhesive layer 120 can be applied to the second facial surface 124 of the facesheet layer 110 in such a manner and by any convenient means.

Figure 7:
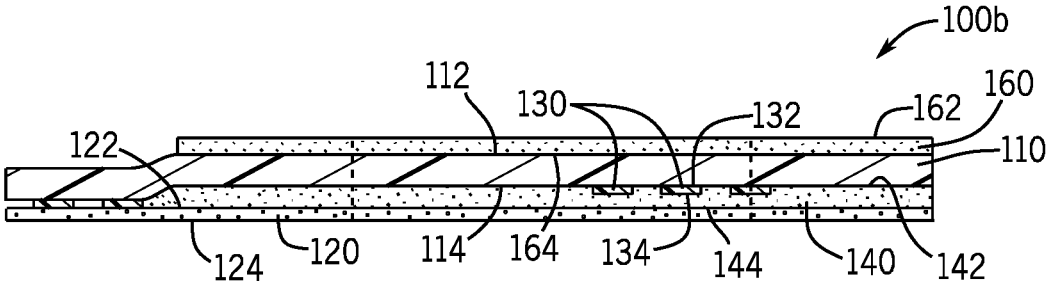
FIG. 7 is a schematic side view cross-section of an embodiment of a label of this invention having more than two layers.

FIG. 7 shows a schematic side view cross-section of a second embodiment of the layers of a label 100*b* according to the present disclosure. Particularly, FIG. 7 shows a label 100*b* comprising a plurality of optional layers.

In the embodiment shown, the label 100*b* includes an topcoat layer 160 having a first facial surface 162 and a second facial surface 164, a facesheet layer 110 having a first facial surface 112 and a second facial surface 114, a release ink layer 130 having a first facial surface 132 and a second facial surface 134, a primecoat ink layer 140 having a first facial surface 142 and a second facial surface 144, and an adhesive layer 120 having a first facial surface 122 and a second facial surface 124.

In the embodiment shown, the first facial surface 112 of the facesheet layer 110 is in contact with the second facial surface 164 of the topcoat layer 160, the first facial surface 132 of the release ink layer 130 is at least in partial contact with the second facial surface 114 of the facesheet layer 110, the first facial surface 142 of the primecoat ink layer 140 is in at least partial contact with the second facial surface 134 of the release ink layer 130 and the second facial surface 114 of the facesheet layer 110, and the first facial surface 122 of the adhesive layer 120 is in contact with the second facial surface 144 of the primecoat ink layer 140. The first facial surface 162 of the topcoat layer is exposed.

The individual layers 160, 110, 130, 140, 120, and 150 can be applied to one another in such a manner and by any convenient means. In embodiments in which a release ink layer 130 is present, the release ink layer 130 is applied to the second facial surface 114 of the facesheet layer 110 such that at least a part of the second facial surface 114 of the facesheet layer 110 is available for contact with at least a part of the first facial surface 142 of the primecoat ink layer 140. The release ink layer 130 is continuous or discontinuous.

In an embodiment, when the release ink layer 130 is present, the release ink layer 130 is present only at the lobe segments 20, 30 and their corresponding protruding member (s) 25, 35. In other words, in an embodiment, there is no release ink layer 130 present at the base segment 10 and pull tab 60.

It will be appreciated that additional layers may be present in the label construction which do not materially alter the essential properties of the label. Similarly, not all layers described with reference to FIG. 7 are necessary in the label construction and any combination of layers may be provided in a label according to the present disclosure, provided the label includes the facesheet layer 110 and the adhesive layer 120.

Figure 8:
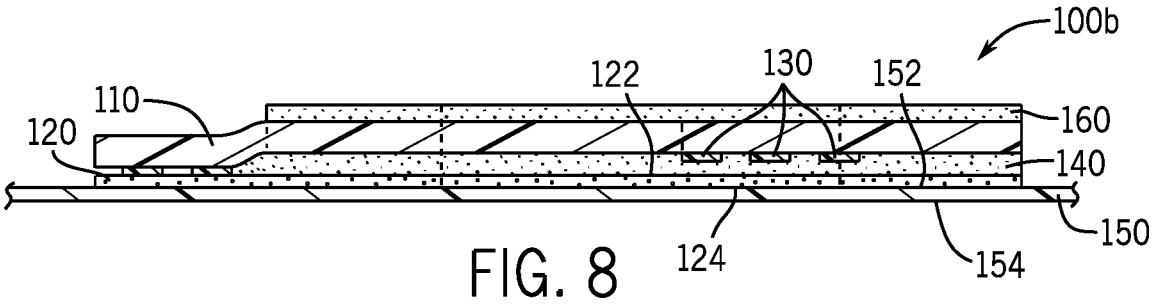
FIG. 8 is a schematic side view cross-section of the label of FIG. 7 on a release liner.
Figure 9:
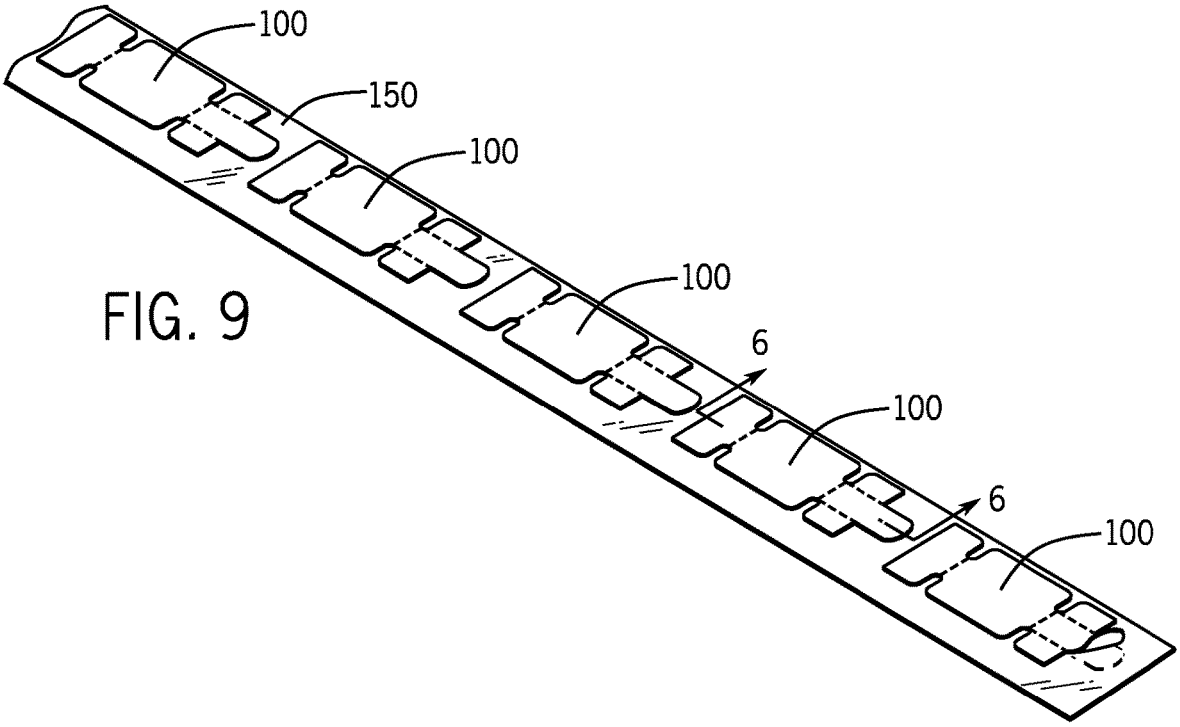
FIG. 9 is a perspective view of a plurality of labels of this invention on a release liner.

In an embodiment, the present disclosure provides a label or plurality of labels provided on a release liner 150, such as shown in FIGS. 8-9. The labels can be according to any one or combination of two or more embodiments described herein.

FIG. 8 is a schematic side view cross-section showing the label 100*b* of FIG. 7 with a release liner layer 150 such that the first facial surface 152 of the release liner 150 is in contact with the second facial surface 124 of the adhesive layer 120 and the second facial surface 154 of the release liner 150 is exposed.

In another embodiment, a label 100*a* such as shown in FIG. 6 can be provided on a release liner 150. In such an embodiment, the first facial surface 152 of the release liner 150 is in contact with the second facial surface 124 of the adhesive layer 120 and the second facial surface 154 of the release liner 150 is exposed, just as shown with reference to label 100*b* and FIG. 8.

FIG. 9 shows a plurality of labels 100*b* provided on the release liner 150. In the embodiment shown, the release liner 150 is shown as a roll, tape or strip of indefinite length and having a width slightly greater than the greatest width of the label 100. The labels 100 are positioned on the release liner 150 in a linear fashion. The shape of the release liner 150 can, however, vary by convenience and take any form or shape including, for example, a sheet, wider strip, or individual unit.

Again, while the labels shown and provided on the release liner are labels 100*b* as described with reference to FIGS. 7-8, it will be understood that labels of any embodiment, including labels 100*a* as described in FIG. 6 may be provided on a release liner 150.

Moreover, while the labels 100*a*, 100*b* are primarily described and shown as having a shape and configuration corresponding to label 100 as described and shown with reference to FIGS. 1-2, it will be understood that similar description is applicable to the various labels 100',100" and 100'" shown in FIGS. 3-5 unless stated to the contrary.

Facesheet Layer

The facesheet layer 110 of the IV port tamper-evident label can be prepared from a wide variety of different polymers including, but not limited to, polyester, polyolefin, polyimide, polycarbonate, acrylic, and composite constructions. Typically and preferably, the facesheet layer is prepared from polyester, particularly a polyethylene terephthalate (PET) ester or a biaxially-oriented polypropylene (BOPP). The facesheet is typically in the form of a film with a typical thickness of 0.002 inches (0.0508 mm) to 0.010 inches (0.254 mm), more typically of 0.003 inches (0.0762 mm) to 0.007 inches (0.1778 mm).

The facesheet layer 110 comprises a first facial surface 112 and a second facial surface 114 opposed to the first facial surface 112. The first facial surface 112 is open to the environment or, in instances when a topcoat is present, the first facial surface 112 is in contact with the topcoat 160.

In one embodiment, the first facial surface 112 of the facesheet layer is coated with an optional topcoat 160. The composition of the optional topcoat 160 can vary widely. In one embodiment, the topcoat 160 comprises a crosslinked polyester binder while in other embodiments the topcoat comprises polyurethane, acrylic, phenoxy, or melamine polymers. In another embodiment, the topcoat layer 160 comprises an ink, such as a UV ink as described with reference to the release ink layer 130 and the primecoat ink layer 140. The topcoat 160, if present, typically has a thickness of 0.00254 mm to 0.0381 mm, more typically of 0.00254 mm to 0.01524 mm.

Adhesive Layer

The adhesive layer 120 can vary widely, and it includes, but is not limited to, materials comprising permanent pressure sensitive acrylic and rubber hybrid acrylic, and rubber pressure sensitive adhesives. In one embodiment, a thermoset polyester or polyurethane adhesive may be utilized. The thickness of the adhesive layer typically is in the range of 0.0005 inches (0.0127 mm) to 0.003 inches (0.0762 mm), more typically of 0.009 inches (0.02286 mm) to 0.002 inches (0.0508 mm).

In an embodiment, the adhesive layer 120 comprises a first adhesive-free portion 12 positioned approximately in the center of the base segment 10 of the label 100 and a second adhesive-free portion 16 on the pull tab 60. As used herein, the terms "adhesive-free," "free of adhesive," "void of adhesive layer" and similar terms mean lacking any adhesive compound whatsoever or containing deadened adhesive compound.

The adhesive layer 120 has a first facial surface 122 and a second facial surface 124. In an embodiment, the first facial surface 122 is in contact with the second facial surface 114 of the facesheet layer 110, such as shown in FIG. 6.

In another embodiment, one or more intervening or intermediate layers are positioned between the first facial surface 122 of the adhesive layer 120 and the second facial surface 114 of the facesheet layer 110, such that the adhesive layer 120 and facesheet layer 100 are not in contact with one another, such as shown in FIGS. 7-8.

In an embodiment, the adhesive layer 120 has a first facial surface 122 in direct contact with the second facial surface 144 of the primecoat ink layer 140, as shown with reference to FIGS. 7-8.

Release Ink Layer

The release ink used in embodiments of the present IV port tamper-evident label can be selected from a wide variety of available materials. Any silicone ink can be used. More preferably, any ultra-violet (UV) epoxy silicone cationic ink containing a cationic photoinitiator, such as iodonium and/or triarylsulphonium salts may be utilized. ACTEGA WIT 501TR IV cationic and TEGO epoxy silicone UV cationic release inks, e.g., TEGO RC 1401, RC 1403, and/or RC 1412 with TEGO photo-catalyst, are representative. Alternative solvent- or water-borne release inks include fluoropolymers and polyvinyl alcohols. The release ink layer 130 typically has a thickness of 0.00127 mm to 0.0127 mm, more typically of 0.00127 mm to 0.00508 mm, and it is typically applied in a manner to form a graphic image visible through the facesheet 110.

Primecoat Ink Layer

In an embodiment, the primecoat ink is a UV ink, e.g., ACTEGA Primecoat RV1001224 UV ink, typically in combination with one or more of a phosphite antioxidant, e.g., IRGAFOS 168 from Ciba Specialty Chemicals (0.5%-3% by mass), a VU/EB (ultra-violet/electron beam) curable resin, e.g., EBECRYL 350 (a silicone diacrylate) from Cytec (0.5%-4% by mass), and a pigment, e.g., CHAOS mile ultra-silk C-901 (3-17 microns) from 5%-30% by mass. In other embodiments, the ACTEGA primecoat ink can be replaced by or combined with one or more primecoat inks abased on free-radical polyester acrylate, aliphatic or aromatic polyurethane acrylate, epoxy acrylate, monomers (including but not limited to 1,6-hexanediol diacrylate, isobornyl acrylate, octyl/decyl acrylate, oxyethylated phenol acrylate, aliphatic acrylate, 2-phenoxyehtyl acrylate, dipropylene glycol giacrylate, tripropylene glycol diacrylate, alicyclic diacrylate, bisphenol-A ethoxylate diacrylate, acrylated dipentaerythritol, propoxylated glycerol triacrylate, trimethylolpropane ethoxy triacrylate, ditrimethyolpropanetetraacrylate, pentaerythritol tri-tetraacrylate, polyether tetraacrylate and propoxylated glycerol triacrylate), typically in combination with a free-radical photoinitiator. Other pigments that can be used in this primecoat ink layer 140 include CHAOS interference pigments, metallic coated pearl pigments and/or white pearl pigments, IRIODINeffect pigments, BI-FLAIR effect pigments, titanium dioxide, silicon dioxide, carbon black and the like. The primecoat ink layer 140 typically has a thickness of 0.00127 mm to 0.0127 mm, more typically of 0.00127 mm to 0.00508 mm.

Release Liner

The release liner 150 used can vary widely, and is typically silicone coated to protect the adhesive until application to a IV port 82 and to carry the label stock through a printer. The preferred release liner 150 is either a film type, or a coated paper to give the adhesive a smooth surface to minimize entrapped air when bonded to the end-use surface (e.g., IV port).

In an embodiment, and for ease of use in high volume manufacturing, the labels are packaged in roll form. In this embodiment, the release liner is in the form of a strip of indefinite length wound about a spool or similar object. Individual labels are removed from the roll as needed and applied to the IV port in the same manner as tacky, tamper-evident labels.

Perforations

As discussed above, the label 100 includes a first perforation 70, a second perforation 72, a third perforation 74 and, optionally, a fourth perforation 76. These perforations 70, 72, 74, 76 extend through each of the layers of the label 100 except any provided release layer 150.

Use

To apply the label to a surface, the release liner 150, if used, is pulled away from the adhesive layer 120 and the label is applied to the surface such that the exposed adhesive layer (i.e., the second facial surface 124 of the adhesive layer 120) is in contact with the surface.

Figure 10A:
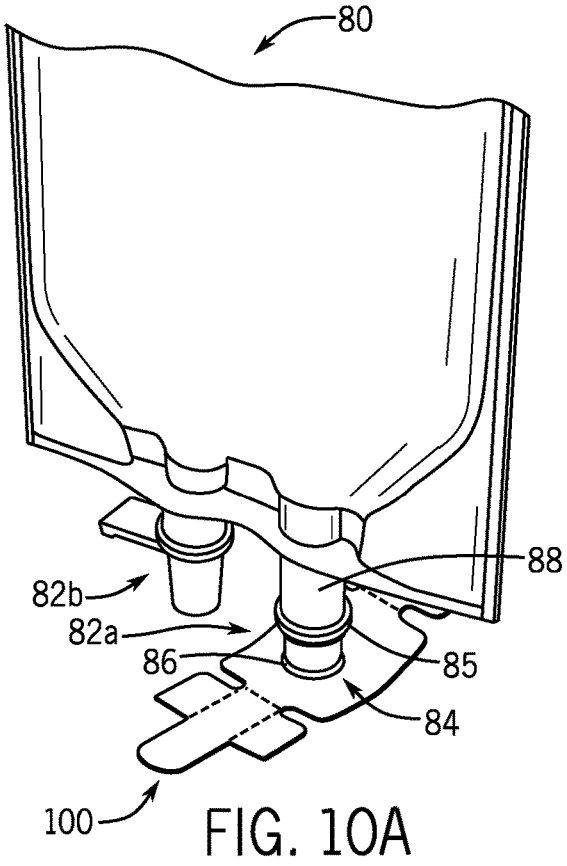
FIGS. 10A-10C depict the process of applying a label of this invention to an IV bag.
Figure 10B:
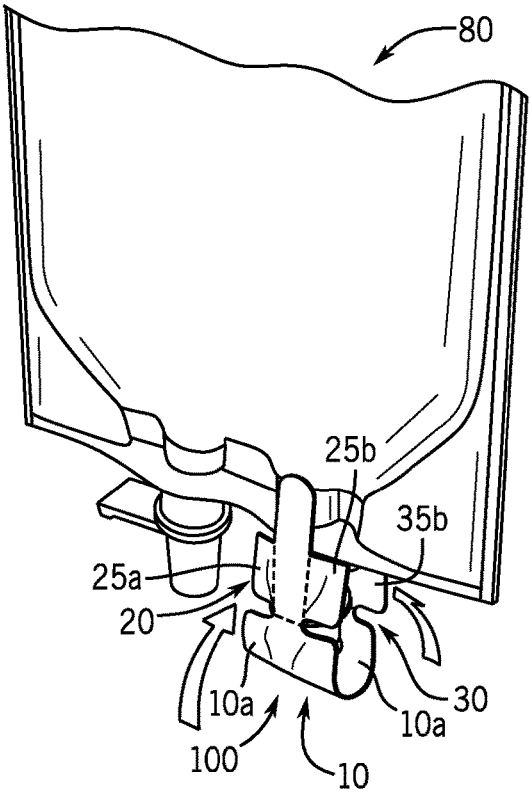
Figure 10C:
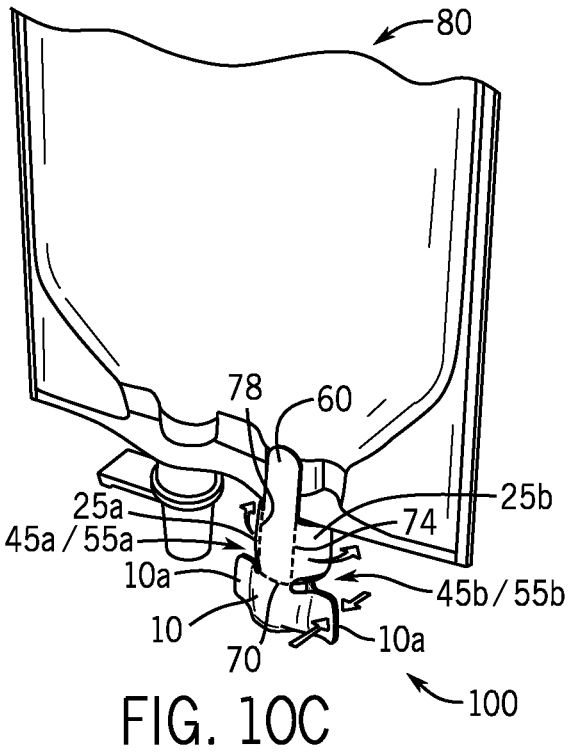

In a specific embodiment, with reference to FIGS. 10A-10C, the label is applied to the IV port 82 of an IV bag 80. FIGS. 11A-11D illustrate the removal of the label from the IV port 82.

To apply the label to an IV port 82, the release liner 150, if used, is pulled away from the adhesive layer 120 and adhesive-free portion 12 of the base segment 10 is aligned with the terminal surface 86 of the IV port 82, as shown in FIG. 10A. The base segment 10 is then folded against the terminal portion 84 of the IV port 82 such that the second facial surface 124 of the adhesive layer 120 on the base segment 10 of the label 100 contacts at least a portion of the outer circumference of the terminal portion 84 of the IV port 82, as shown in FIG. 10B. In folding the label 100 along the IV port 82 in such a manner, the second facial surface 124 of the adhesive layer 120 of the lobe segment 20, 30 is also brought into contact with the tubing portion 88 of the IV port 82, as shown in FIG. 10B.

In some embodiments, such as shown in FIGS. 10A-11D, an IV port 82 includes a transitioning flange 85 between the terminal portion 84 of the IV port 82 and the tubing portion 88 of the IV port 82. In the embodiments shown, the label 100 sizing is such that the cutout portions 40, 50 align with the transitioning flange 85.

After the base segment 10 is folded against the IV port 82, any excess or hangover base portion 10*a* as shown in FIG. 10B, is pinched together as shown in FIG. 10C. The protruding members 25*a*, 25*b*, 35*a*, 35*b* in the embodiment shown are wrapped around the tubing portion 88 of the IV port 82. While the label 100 in the embodiment shown in FIGS. 10A-11D has lobe segments 20, 30 each including two protruding members 25*a*, 25*b*, 35*a*, 35*b*, it will be appreciated that labels with lobe segments 20, 30 having different numbers of protruding members may be used, and the protruding members will be wrapped around the tubing portion 88 of the IV port 82 just as described with reference to the embodiments shown in FIGS. 10A-11D.

As shown in FIGS. 10B-10C, the protruding members 25*a*, 25*b*, 35*a*, 35*b* do not wrap all the way around the tubing portion 88 of the IV port 82, nor do they wrap around the tubing portion 88 such that corresponding pairs of protruding members 25*a*, 25*b* and 35*a*, 35*b* contact each other. Rather, there is a gap (26, 36 (not shown)) between the corresponding pairs of protruding members 25*a*, 25*b* and 35*a*, 35*b*, and corresponding opposing protruding members 25*a*, 35*a* and 25*b*, 35*b* overlap one another, shown perhaps best in FIG. 11C. In the particular embodiment shown, protruding members 25*a* and 25*b* overlap 35*a* and 35*b*, respectively. However, it will be understood which protruding member overlaps a corresponding opposing protruding member depends on which protruding member(s) are wrapped first.

Moreover, which protruding members are wrapped first and which protruding members overlap which protruding members is not important. Rather, the fact that the protruding members overlap at all is what is of importance. By virtue of the overlap, at least a portion of the second facial surface 124 of the adhesive layer 120 is in contact with the first facial surface 112 of the facesheet layer 110 (or the first facial surface 162 of the optional topcoat 160 layer). As a result, adhesion of the label 100, as a whole, to the IV port 82 is not entirely dependent on contact of the second facial surface 124 of the adhesive layer 120 with the surface of the IV port 82, which can contain contaminants which decrease the effectiveness of the adhesive compound.

Figure 11A:
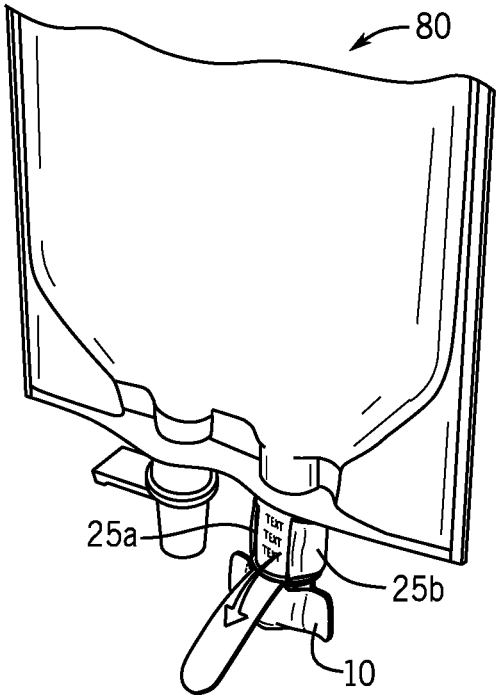
FIGS. 11A-11D depict the process of removing a label of this invention from an IV bag.
Figure 11B:
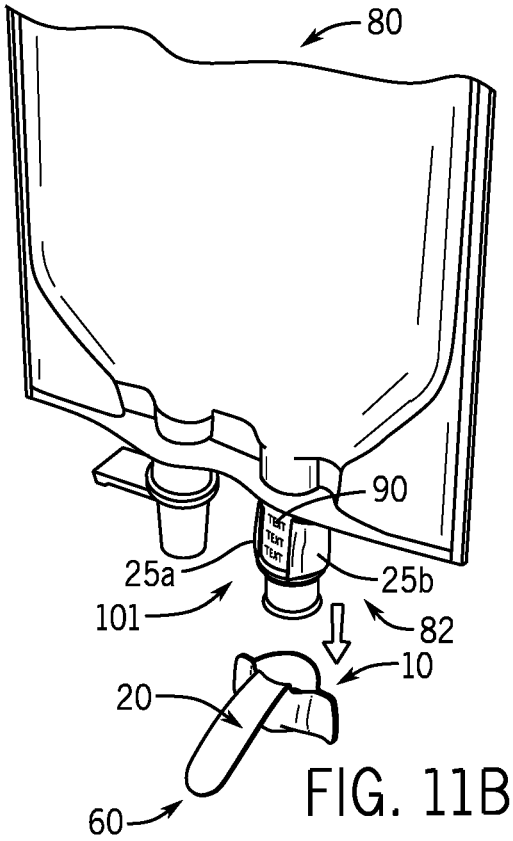
Figure 11C:
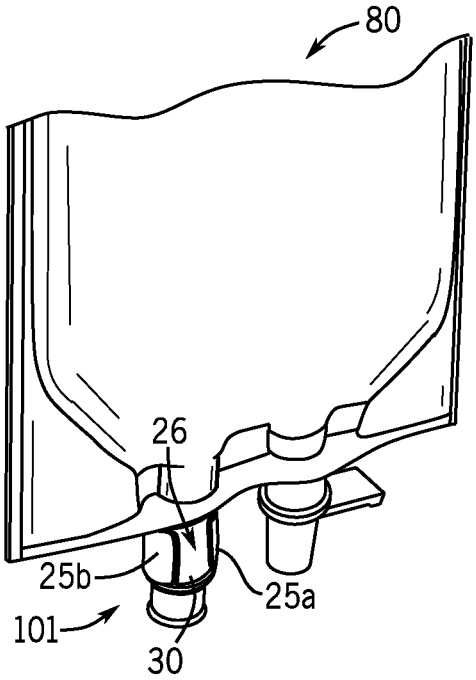

To remove the label 100 from the IV port 82, the pull tab 60, which is adhesive-free, is pulled outward from the IV port 82 and towards the base segment 10 such that a tear propagates along perforations 74 and 76, as shown in FIG. 11A. Continued pulling of the pull tab 60, and therefore portion of the lobe segment (in the embodiment shown in FIGS. 10A-11D it is the first lobe segment 20), causes tearing to propagate along perforations 70 and 72 and ultimately the base segment 10 is complete removed from the terminal portion 84 of the IV port 82, as shown in FIGS. 11B and 11C. The remaining portions of the lobe segments 20, 30 and the protruding members 25*a*, 25*b*, 35*a*, 35*b* remain secured around the tubing section 88 of the IV port 82 forming a collar around the tubing portion 88 as shown more clearly in FIG. 11D.

In some instances, it is possible for a tear to unintentionally begin and propagate along any of the perforations 70, 72. 74, 76 and, in instances, cause the base segment 10 to unintentionally detach from the IV port 82. In other instances, a tear may propagate along any of the perforations 70, 72. 74, 76 and/or the base segment 10 may be removed from the IV port 82 when the IV bag 80 is tampered with. In either instance, the remaining collar portion (composed of any remaining first lobe segment 20, the second lobe segment 30, and their respective protruding member(s) 25, 35) serves as a visual indicator that the seal created by the label 100 is not intact and there may be potential contamination of the medication in the IV bag 80 or of the port 82.

Figure 11D:
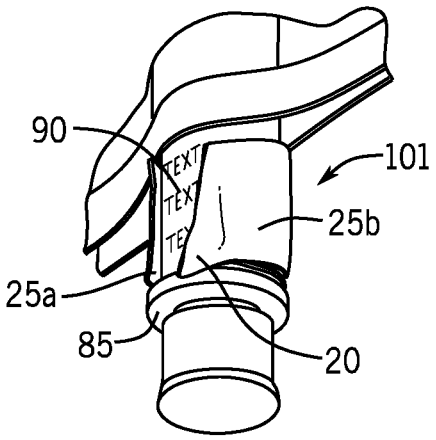

As shown with reference to FIG. 11D, in some embodiments in which the label 100 includes a release ink layer 120, the release ink layer is configured such that portions of the primecoat ink layer 130 remain adhered to the IV port 82 and form a graphic 90 on the IV port 82 when the label 100, or portions of the label 100, are removed. More specifically, as the label 100 or portions of the label 100 are moved, the label or those portions thereof divide into two pieces such that the release ink layer 130 remains attached to the facesheet layer 110 and the primecoat ink layer 140 will split such that part (where the release ink layer is not) remains attached to the primecoat ink layer 140 and another part (where the release ink layer was) remains attached to the adhesive layer 120.

In a preferred embodiment in which the label includes a release ink layer 130, the release ink layer is present only at the lobe segments 20, 30 and their corresponding protruding member(s) 25, 35. As a result, when the label 100 or portions of the label 100 are removed from the IV port 82, only the parts of the IV port 82 which were in contact with the lobe segments 20, 30 and/or their corresponding protruding member(s) 25, 35 will have a graphic 90, as shown in FIGS. 11B and 11D.

In an embodiment, the graphic 90 is text. However, in other embodiments, the graphic 90 may be any pattern, text or image which is visible on the IV port 82. In a preferred embodiment, the graphic 90 is white; however, in other embodiments, the color of the graphic 90 can vary by preference, or even be multicolored, by changing the pigmentation of the primecoat ink layer 140.

In particular, in the embodiment shown in FIG. 11D, the base segment 10 of the label 100 has been removed from the terminal portion of the IV port and the pull tab 60 and at least a portion of the first lobe segment 20 have been removed from the tubing portion 88 of the IV port 82. Because only the lobe segments 20, 30 and their corresponding protruding member(s) 25, 35 include a release ink layer 130, the only portion of the IV port that shows a graphic 90 is the portion of the tubing section 88 of the IV port 82 which was previously covered by the first lobe segment 20. If the collar formed by the remaining portions of the first and second lobe segments and their respective protruding members 25*a*, 25*b*, 35*a*, 35*b* is removed from the IV port, then the graphic 90 would appear around the circumference of the tubing portion 88 of the IV port 82 where the label had been in contact.

It will be understood that the graphic 90 therefore serves as a further visual indicator showing inadvertent removal of the label 100 or potential tampering.

While the above describes the use of a label with reference to the label 100 of FIGS. 1-2, it will be understood that similar description is applicable to the various labels 100', 100" and 100'" shown in FIGS. 3-5 and, similarly, labels 100*a* and 100*b* of FIGS. 6-8 unless stated to the contrary.

IV Bag

In an embodiment, the present disclosure provides an IV bag 80 bearing a label according to any one or combination of two or more embodiments disclosed herein.

In an embodiment, the IV bag comprises at least one port 82; however, IV bags generally include at least two ports—a first port 82*a* being a medication port and a second port 82*b* being an IV tubing port, as shown in FIG. 10A. Regardless of the type of IV port, IV ports generally comprise (1) a terminal portion 84 having a terminal surface 86 and (2) a tubing portion 88. The terminal portion 84 is the portion that is connected to IV tubing or used to inject a medication into the IV bag and the terminal surface 86 is the surface onto which IV tubing is connected or the surface through which a needle passes to inject the medication. The tubing portion 88 connects the IV port 82 to the bag 80.

The size, shape and configuration of IV bags and their respective ports can vary. For example, IV bags come in a range of sizes from 50 ml to 1000 ml, with the shape of the bags varying by manufacture. Similarly, the number and positioning of ports varies and in some embodiments the number and positioning of ports is dependent on the size and shape of the IV bag. The specific dimensions of the parts of the IV ports also vary and, in some embodiments, vary by manufacturer so that other consumables (e.g., connectors, connection tubes, etc.) must be purchased from the same supplier.

In the embodiments shown, the IV bag is designed to hold from 50 ml, or from 100 ml to 500 ml, or to 250 ml. The outside diameter of the terminal surface 86 of the port 82 is from 0.2 inches, or from 0.22 inches, or from 0.24 inches, or from 0.26 inches, or from 0.28 inches, or from 0.3 inches to 0.5 inches, or to 0.48 inches, or to 0.46 inches, or to 0.44 inches, or to 0.42 inches, or to 0.4 inches. The overall length of the port (length of the terminal portion 84+length of the tubing portion 88) is from 0.5 inches, or from 0.75 inches, or from 1 inch, or from 1.25 inches, or from 1.5 inches to 3.0 inches, or to 2.75 inches, or to 2.5 inches, or to 2.25 inches, or to 2 inches, or to 1.75 inches, or to 1.5 inches, or to 1.25 inches. The length of the tubing portion 88 is from 0.25 inches, or from 0.5 inches, or from 0.6 inches, or from 0.7 inches, or from 0.8 inches, or from 0.9 inches, or from 1.0 inches, to 2.5 inches, or to 2.25 inches, or to 2.0 inches, or to 1.75 inches, or to 1.5 inches, or to 1.25 inches, or to 1.0 inches, or to 0.9 inches, or to 0.8 inches, or to 0.7 inches, or to 0.6 inches, or to 0.5 inches.

In the specific embodiment shown, the IV bag is a 100 ml to 250 ml IV bag with an outside port diameter of from 0.2 inches to 0.4 inches, an overall length of 1.0 inches to 1.25 inches, and a tubing portion length of from 0.5 inches to 0.9 inches.

In an embodiment, the IV bag is a 100 ml IV bag with an outside port diameter of 10.2 mm (0.4 inches), a total port length of 1.0 inches, and a tubing portion length of 12.7 mm (0.5 inches).

In an embodiment, the IV bag is a 250 ml IV bag with an outside port diameter of 7.6 mm (0.3 inches), a total port length of 1.1875 inches, and a tubing portion length of 22.23 mm (0.875 inches).

In an embodiment, the label 100 can be used with respect to either an IV tubing port or a medication port. Preferably, the label 100 is used with a medication port.

In an embodiment, the IV bag 80 (A) includes at least one port 82, the port 82 having (i) a terminal portion 84 comprising a terminal surface 86 and (ii) a tubing portion 88 and (B) bears a label 100. The label 100 can be according to any one or combination of two or more embodiments as disclosed herein.

In an embodiment, the base segment 10 of the label 100 is in contact with at least a portion of the terminal portion 84 of the IV port 82, such as shown in FIG. 10C. In a preferred embodiment, the base segment 10 includes a central portion 12 which is adhesive-free. In the preferred embodiment, the adhesive-free portion 12 of the base segment 10 is in contact with the terminal surface 86 of the IV port 82.

In an embodiment, the first lobe segment 20 is in contact with at least a portion of the tubing portion 88 of the IV port 82 and the second lobe segment 30 is in contact with at least a portion of the tubing portion 88 of the IV port 82, as shown in FIG. 10C.

In an embodiment, the at least one protruding member 25 of the first lobe segment 20 and the at least one protruding member 35 of the second lobe segment 30 are in overlapping contact such that at least a portion of the second facial surface 124 of the adhesive layer 120 of the label 100 is in contact with at least a portion of the first facial surface 112 of the facesheet layer (or, optionally, the first facial surface 162 of the primecoat layer 160, when present) of the label 100.

In one embodiment, each of the first and second lobe segments 20, 30 include a single protruding member 25, 35. In such an embodiment, the protruding members 25, 35 are wrapped around the tubing portion 88 of the IV port 82 such that one of the protruding members (e.g., 25) overlaps with at least a portion of the other protruding member (e.g., 35). Which protruding member overlaps with which is not as important as the fact that the protruding members overlap, as discussed above.

In one embodiment, each of the first and second lobe segments 20, 30 include a pair of protruding members 25*a*, 25*b*, 35*a*, 35*b*. In such an embodiment, the protruding members 25*a*, 25*b*, 35*a*, 35*b* are wrapped around the tubing portion 88 of the IV port 82 such that the protruding members 25*a*, 25*b*, 35*a*, 35*b* form corresponding overlapping pairs, i.e., protruding members 25*a*, 35*a* form a first overlapping pair and protruding members 25*b*, 35*b* form a second overlapping pair, as shown in FIG. 10C. Again, in the embodiment shown in FIG. 10C, both of the protruding members 25*a*, 25*b* of the first lobe segment 20 overlap the corresponding opposing protruding member 35*a*, 35*b* of the second lobe segment 30. In such an embodiment, as described above, the protruding members 35*a*, 35*b* of the second lobe segment 30 were wrapped around the tubing portion 88 of the IV port 82 first and the protruding members 25*a*, 25*b* of the first lobe segment 20 were subsequently wrapped. However, in other embodiments, the protruding members 35*a*, 35*b* of the second lobe segment 30 may overlap the protruding members 25*a*, 25*b* of the first lobe segment 20. In still further embodiments, one of the protruding members 25*a*, 25*b* of the first lobe segment 20 can overlap a corresponding opposing one of the protruding members 35*a*, 35*b* of the second lobe segment 30, while the other of the protruding members 35*a*, 35*b* of the second lobe segment 30 overlaps its corresponding opposing one of the protruding members 25*a*, 25*b*.

In another embodiment, the present disclosure provides an IV bag 80 bearing at least a portion of a label 101 according to any one or combination of two or more embodiments disclosed herein. Preferably, the IV bag 80 comprises at least one port 82, as described above, and the at least a portion of a label 101 is in contact with the tubing portion 88 of the at least one IV port 82.

In an embodiment, as shown in FIGS. 11B-11D, the at least a portion of the label 101 comprises (1) a portion of the lobe segment 20 or 30 to which the pull tab 60 was attached (e.g., the first lobe segment 20 in the embodiment shown), (2) the other lobe segment 20, 30 (e.g., the second lobe segment 30 in the embodiment shown), and (3) the protruding member(s) 25, 35 of the first and second lobe segments 20, 30. In some embodiments, however, the lobe section to which the pull tab 60 is connected may be entirely removed, in which case the at least a portion of the label 101 comprises only (2) and (3), above.

While the above describes an IV bag with an affixed label or portion thereof with reference to the label 100 of FIGS. 1-2, it will be understood that similar description is applicable to the various labels 100',100" and 100'" shown in FIGS. 3-5 and, similarly, labels 100*a* and 100*b* of FIGS. 6-8 unless stated to the contrary.

It is specifically intended that the present invention not be limited to the embodiments and illustrations contained herein, but include modified forms of those embodiments including portions of the embodiments and combinations of elements of different embodiments as come within the scope of the following claims.

What is claimed is:

1. A label comprising:

(a) a base segment, (b) a first lobe segment comprising at least one protruding member and a pull tab, (c) a second lobe segment comprising at least one protruding member, (d) a first cutout segment, (e) a second cutout segment, (f) a first perforation forming a boundary between the base segment and the first lobe segment, (g) a second perforation forming a boundary between the base segment and the second lobe segment, and (h) a third perforation forming a boundary between the first lobe segment and the at least one protruding member of the first lobe segment;

wherein the first lobe segment is connected to the base segment and the second lobe segment is connected to the base segment and opposed to the first lobe segment, wherein the first cutout segment separates the at least one protruding member of the first lobe segment from the base segment, wherein the second cutout segment separates the at least one protruding member of the second lobe segment from the base segment, and wherein the label comprises at least (A) a facesheet layer and (B) an adhesive layer.

2. The label of claim 1, wherein the base segment comprises a central adhesive-free area.

3. The label of claim 1, wherein the (A) facesheet layer and (B) adhesive layer each comprise a first facial surface and a second facial surface and wherein the second facial surface of the facesheet layer is in direct contact with the first facial surface of the adhesive layer.

4. The label of claim 1, wherein the (A) facesheet layer and (B) adhesive layer each comprise a first facial surface and a second facial surface and wherein at least one intermediate layer is positioned between the second facial surface of the facesheet layer and the first facial surface of the adhesive layer.

5. The label of claim 4, wherein the at least one intermediate layer comprises two layers: (C) a release ink layer and (D) a primecoat ink layer.

6. The label of claim 5, wherein the (A) facesheet layer, (B) adhesive layer, (C) release ink layer, and (D) primecoat ink layer each comprise a first facial surface and a second facial surface, wherein:

(i) the first facial surface of the release ink layer is in contact with at least a portion of the second facial surface of the facesheet layer, (ii) the first facial surface of the primecoat ink layer is in contact with at least a portion of the second facial surface of the release ink layer and at least a portion of the second facial surface of the facesheet layer, and (iii) the first facial surface of the adhesive layer is in contact with the second facial surface of the primecoat ink layer.

7. The label of claim 1, wherein the label further comprises (E) a topcoat layer in contact with (A) the facesheet layer.

8. The label of claim 1, wherein the label further comprises (F) a release liner in contact with (B) the adhesive layer.

9. The label of claim 1, wherein the first and second lobe segments each comprise two protruding members.

10. The label of claim 1, wherein the base segment is rectangular.

11. The label of claim 1, wherein at least one protruding members of the first and second lobe segments are rectangular.

12. The label of claim 1, wherein the label is an IV port label.

13. The label of claim 1, wherein the base segment comprises a central adhesive-free area.

14. The label of claim 13, wherein the central adhesive-free area is in contact with the terminal surface of the IV port.

15. A release liner in the form of a roll carrying a plurality of labels, the labels comprising (a) a base segment, (b) a first lobe segment comprising at least one protruding member and a pull tab, (c) a second lobe segment comprising at least one protruding member, (d) a first cutout segment, (e) a second cutout segment, (f) a first perforation forming a boundary between the base segment and the first lobe segment, (g) a second perforation forming a boundary between the base segment and the second lobe segment, and (h) a third perforation forming a boundary between the first lobe segment and the at least one protruding member of the first lobe segment;

wherein the first lobe segment is connected to the base segment and the second lobe segment is connected to the base segment and opposed to the first lobe segment, wherein the first cutout segment separates the at least one protruding member of the first lobe segment from the base segment, wherein the second cutout segment separates the at least one protruding member of the second lobe segment from the base segment, wherein the label comprises at least (A) a facesheet layer and (B) an adhesive layer, wherein the adhesive layer comprises a first facial surface and a second facial surface, and the second facial surface is in contact with the release liner.

16. A release liner in the form of a roll carrying a plurality of label of claim 1.

17. An IV bag comprising an IV port, the IV port (1) having (i) a terminal portion comprising a terminal surface and (ii) a tubing portion and (2) bearing a label, the label comprising (a) a base segment, (b) a first lobe segment comprising at least one protruding member and a pull tab, (c) a second lobe segment comprising at least one protruding member, (d) a first cutout segment, (e) a second cutout segment, (f) a first perforation forming a boundary between the base segment and the first lobe segment, (g) a second perforation forming a boundary between the base segment and the second lobe segment, and (h) a third perforation forming a boundary between the first lobe segment and the at least one protruding member of the first lobe segment;

wherein the first lobe segment is connected to the base segment and the second lobe segment is connected to the base segment and opposed to the first lobe segment, wherein the first cutout segment separates the at least one protruding member of the first lobe segment from the base segment, wherein the second cutout segment separates the at least one protruding member of the second lobe segment from the base segment, wherein the label comprises at least (A) a facesheet layer and (B) an adhesive layer, each of the (A) facesheet layer and (B) adhesive layer comprising a first facial surface and a second facial surface; and wherein:

(I) the base segment is in contact with at least a portion of (i) the terminal portion of the IV port, (II) the (b) first lobe segment is in contact with at least a portion of (ii) the tubing portion of the IV port, (III) the (c) second lobe segment is in contact with at least a portion of (ii) the tubing portion of the IV port, and (IV) the at least one protruding member of (b) the first lobe segment and the at least one protruding member of (c) the first lobe segment are in overlapping contact such that at least a portion of the second facial surface of the adhesive layer is in contact with at least a portion of the first facial surface of the facesheet layer.

18. An IV bag comprising an IV port, the IV port (1) having (i) a terminal portion comprising a terminal surface and (ii) a tubing portion and (2) bearing a label of claim 1.

19. A method of applying a label to an IV port, wherein the IV port comprises (i) a terminal portion comprising a terminal surface and (ii) a tubing portion, the method comprising:

(1) providing a label comprising (a) a base segment, (b) a first lobe segment comprising at least one protruding member and a pull tab, (c) a second lobe segment comprising at least one protruding member, (d) a first cutout segment, (e) a second cutout segment, (f) a first perforation forming a boundary between the base segment and the first lobe segment, (g) a second perforation forming a boundary between the base segment and the second lobe segment, and (h) a third perforation forming a boundary between the first lobe segment and the at least one protruding member of the first lobe segment;

wherein the first lobe segment is connected to the base segment and the second lobe segment is connected to the base segment and opposed to the first lobe segment, wherein the first cutout segment separates the at least one protruding member of the first lobe segment from the base segment, wherein the second cutout segment separates the at least one protruding member of the second lobe segment from the base segment, wherein the label comprises at least (A) a facesheet layer and (B) an adhesive layer;

(2) aligning the terminal surface of the IV port with the center of the base segment;

(3) folding the base segment against the terminal portion of the IV port such that (A) the base segment is in partial contact with the terminal portion, (B) the first lobe segment is in contact with at least a portion of the tubing portion of the IV port, and (C) the second lobe segment is in contact with at least a portion of the tubing portion of the IV port;

(4) wrapping a first of the at least one protruding members of the first lobe segment or second lobe segment around the tubing portion of the IV port; and (5) wrapping a second of the at least one protruding members of the first lobe segment or second lobe segment around the tubing portion of the IV port.

20. A method of applying a label to an IV port, wherein the IV port comprises (i) a terminal portion comprising a terminal surface and (ii) a tubing portion, the method comprising:

(1) providing a label of claim 1;

(2) aligning the terminal surface of the IV port with a center of the base segment;

(3) folding the base segment against the terminal portion of the IV port such that (A) the base segment is in partial contact with the terminal portion, (B) the first lobe segment is in contact with at least a portion of the tubing portion of the IV port, and (C) the second lobe segment is in contact with at least a portion of the tubing portion of the IV port;

(4) wrapping a first of the at least one protruding members of the first lobe segment or second lobe segment around the tubing portion of the IV port; and (5) wrapping a second of the at least one protruding members of the first lobe segment or second lobe segment around the tubing portion of the IV port.

* * * * *